US006994582B1

(12) United States Patent
Carney et al.

(10) Patent No.: US 6,994,582 B1
(45) Date of Patent: Feb. 7, 2006

(54) CONNECTOR MODULE

(75) Inventors: William V. Carney, Glen Cove, NY (US); Alan J. Squillante, Kings Park, NY (US); Michael Fasano, Huntington, NY (US); Michael Belle-Oudry, Centereach, NY (US); Anthony Andrew Ray, Massapequa Park, NY (US); Clifford D. Le Strange, Stony Brook, NY (US)

(73) Assignee: Porta Systems Corporation, Syosset, NY (US)

( * ) Notice: Subject to any disclaimer, the term of this patent is extended or adjusted under 35 U.S.C. 154(b) by 0 days.

(21) Appl. No.: 10/540,083

(22) PCT Filed: Dec. 22, 2003

(86) PCT No.: PCT/US03/41836

§ 371 (c)(1),
(2), (4) Date: Jun. 17, 2005

(87) PCT Pub. No.: WO2004/059795

PCT Pub. Date: Jul. 15, 2004

Related U.S. Application Data

(60) Provisional application No. 60/435,224, filed on Dec. 20, 2002.

(51) Int. Cl.
*H01R 11/20* (2006.01)

(52) U.S. Cl. ..... 439/404; 439/709

(58) Field of Classification Search ..... 439/404, 439/709, 922, 532, 719, 417, 418, 395, 540.1
See application file for complete search history.

(56) References Cited

U.S. PATENT DOCUMENTS

| | | | | |
|---|---|---|---|---|
| 3,798,587 A | | 3/1974 | Ellis, Jr. et al. | 339/97 P |
| 4,171,857 A | | 10/1979 | Forberg et al. | 339/97 P |
| 4,283,103 A | | 8/1981 | Forberg et al. | 339/59 M |
| 5,086,368 A | * | 2/1992 | Gerke et al. | 361/118 |
| 5,549,489 A | * | 8/1996 | Baggett et al. | 439/709 |
| 5,575,689 A | | 11/1996 | Baggett et al. | 439/709 |
| 5,622,516 A | * | 4/1997 | Baggett et al. | 439/408 |
| 5,647,760 A | * | 7/1997 | Drach et al. | 439/395 |
| 5,722,850 A | * | 3/1998 | White | 439/404 |
| 5,816,854 A | | 10/1998 | Baggett et al. | 439/540.1 |
| 5,820,404 A | | 10/1998 | Chishima et al. | 439/417 |
| 6,074,257 A | * | 6/2000 | Fasano | 439/713 |

* cited by examiner

*Primary Examiner*—Tho D. Ta
(74) *Attorney, Agent, or Firm*—Gerald T. Bodner

(57) ABSTRACT

A connector module permits termination of cross-connect wires on one surface (front) and cable wires on an opposite surface (rear). The module exhibits a configuration, which permits test access and protector (i.e., protection module) mounting from the front surface. The jumper wires are inserted from a side surface through wire guides or channels that bring the wires from the side surface to the front surface where the wires can be terminated without impeding insertion and removal of protection modules from the front of the connector module. There is an intermediate surface below the front surface that is accessible from the front and recessed to allow protection modules to be installed completely below the terminated wires, allowing termination and maintenance of jumper wires after the protection module is installed from the front.

19 Claims, 23 Drawing Sheets

CONNECTOR MODULE

This application claims the benefit of Provisional Application No. 60/435,224, filed Dec. 20, 2002.

BACKGROUND OF THE INVENTION

1. Field of the Invention

This invention generally relates to connector modules used in the telecommunications industry, and more particularly relates to connector modules and blocks which receive protection modules to protect electrically telecommunications equipment connected thereto.

2. Description of the Prior Art

In the telecommunications industry, connector blocks comprising an array of insulation displacement contacts are typically used in central offices, building entrance terminals, and outside plant cabinets for electrical connection between cables and cross connect wiring. One example is the standard 110-connector block (see, for example, U.S. Pat. No. 3,798,587, the disclosure of which is incorporated herein by reference). Such connector blocks usually are formed from a plurality of parallelly arranged connector modules. Some connector modules include slots for mounting protectors (i.e., protection modules) which are electrically connected to the contacts (see, for example, U.S. Pat. Nos. 4,171,857 and 4,283,103, the disclosures of which are incorporated herein by reference). Such connector modules are inconvenient to the user because the protection modules must usually be removed to add, move, or remove jumper wires.

To improve connection density, some connector modules include terminations on two surfaces. One such connector module has provisions to install protectors on either the front or rear surface of the module (see, for example, U.S. Pat. No. 5,575,689, the disclosure of which is incorporated herein by reference). Such connector modules make it more convenient to add, move, or remove jumper wires because the protector does not have to be removed to add, move, or remove jumper wires. However, such connector modules have the disadvantage of requiring access to the rear of the module to add, remove, or replace protectors.

OBJECTS AND SUMMARY OF THE INVENTION

It is an object of the present invention to provide a connector module for use in a telecommunications system.

It is another object of the present invention to provide a connector module which receives protectors that need not be removed when the connector module requires wiring changes.

It is a further object of the present invention to provide a connector module which receives protectors and wherein the protectors and connector wiring is easily accessible from the same side of the connector module.

It is still another object of the present invention to provide a connector module and protection module cooperating therewith.

It is yet a further object of the present invention to provide a connector module for a telecommunications system which overcomes the inherent disadvantages of known connector modules.

The invention is a connector module, which in one form of the present invention includes two rows of contacts mounted within an insulating housing having a front, an intermediate, and a rear surface. Each contact includes an end portion, which is capable of providing electrical connection to wires. The intermediate surface has slots to accept the protector, which can be installed from the front of the module. This configuration allows the convenience of easily maintaining jumper wires with front mounted protectors that can stay in place during such maintenance. Various cooperating protection modules (i.e., protectors) are disclosed herein and form part of the present invention.

A preferred form of a first embodiment formed in accordance with the present invention of a connector module modules therefor is illustrated, for example, by FIGS. 1–12 of the drawings. The connector module for a telecommunications system has a main body portion which includes a front cap and a rear cap opposite the front cap. The front cap and the rear cap reside in different planes and are elevationally offset from each other to define a middle portion. The middle portion has a front facing surface recessed from the front cap. The front cap defines the front of the connector module. The rear cap defines the opposite rear of the connector module. At least the front cap has a plurality of slits formed therein. The rear cap may also have a plurality of slits formed therein.

The connector module further includes a plurality of first electrical contacts which are at least partially disposed within the front cap of the main body portion. The connector module may further include a plurality of second electrical contacts which are at least partially disposed within the rear cap of the main body portion. Each first electrical contact of the plurality of first electrical contacts is aligned with a respective slit formed in the front cap. Similarly, each second electrical contact of the plurality of second electrical contacts, if included, is aligned with a slit formed in the rear cap. Each first electrical contact has a portion thereof which is exposed through the respective slit to which it is aligned and, therefore, is electrically contactable with a wire received by the corresponding slit formed in the front cap. Similarly, if provided, the second electrical contacts are aligned with respective slits formed in the rear cap and are, therefore, electrically contactable with a wire received by a corresponding slit formed in the rear cap.

The main body portion has an upper surface for supporting a plurality of protection modules thereon between the front cap and the front facing surface of the middle portion. The depth of the upper surface between the front cap and the front facing surface of the middle portion is dimensioned to be at least equal to the longitudinal length of the protection modules so that the protection modules, when supported on the upper surface of the main body portion, have no portion thereof overlying the plurality of slits formed in the front cap. In this manner, the protection modules do not interfere with the placement and removal of wires respectively into and from the plurality of slits formed in the front cap and the selective electrical connection with the plurality of first electrical contacts while the protection modules are supported on the main body portion of the connector module.

Each protection module of the plurality of protection modules associated with the aforementioned connector module is selectively in electrical communication with at least one first electrical contact of the plurality of first electrical contacts when the protection module is supported on the main body of the connector module. The protection modules may similarly be in electrical communication with the second electrical contacts if such are provided. Each protection module of the plurality of protection modules has a longitudinal length which is equal to or less than (that is, at most equal to) a distance between the front facing surface of the middle portion of the connector module and the front cap of the connector module so as not to overlie a corresponding slit of the plurality of slits formed in the front cap and so as not to interfere with the placement and removal of wires respectively into and from the plurality of slits and the selective electrical connection with the plurality of first electrical contacts while the protection modules are supported on the main body of the connector module.

The front facing surface of the middle portion may include a plurality of openings formed therein for receiving outwardly extending portions of the protection modules. The front facing surface may further include ground contacts extending outwardly therefrom for being received by corresponding openings formed in the protection modules.

The main body portion of the connector module may further include a plurality of guide channels formed therein for receiving respective wires for connection to the plurality of first electrical contacts. Even more specifically, the main body portion may further include opposite lateral side walls, wherein at least one of the opposite lateral side walls has formed therein a plurality of side openings. A plurality of front openings may further be included and formed in the front cap of the main body portion. Each front opening is situated in close proximity to the exposed portion a respective first electrical contact and to a corresponding slit formed in the front cap. The side openings and front openings communicate with respective guide channels to allow electrical wires to be received by the side openings, guide channels and front openings for routing of the wires to the first electrical contacts at the plurality of slits formed in the front cap.

The connector module may further include structure on the protection module supporting surface for retaining the protection modules in place on the supporting surface. Such retaining structure may include a plurality of projections extending outwardly from the supporting surface, the projections selectively lockingly engaging the protection modules positioned on the supporting surface to selectively secure the protection modules thereto. Such projections may have a dovetail configuration in transverse cross-section.

Another form of a connector module and associated protection modules therefor, in accordance with a second embodiment of the present invention, is illustrated, for example, by FIGS. 13–17 of the drawings. Each protection module of the plurality of protection modules has a housing defining a cavity therein, a carrier at least partially residing in the housing, and protection components mounted on the carrier. The housing has a lower wall through which an extended portion of the carrier protrudes. The extended portion of the carrier has exposed electrical contacts situated thereon.

The connector module which works in conjunction with the protection modules just described, includes an insulating housing having a rear contact holder portion and a front contact housing joined to the rear contact holder portion. A plurality of rear electrical contacts are at least partially housed by the rear contact holder portion. A plurality of front electrical contacts are at least partially housed by the front contact housing. Either the front contact housing or the rear contact holder portion, or both, has an upper surface and a plurality of grooves formed in the upper surface thereof. Each groove is positioned in proximity to a respective front electrical contact and a respective rear electrical contact such that portions of the respective front electrical contact and rear electrical contact are exposed and extend partially into the respective groove. A protection module is selectively mountable on the upper surface of the front contact housing or rear contact holder portion, or both, such that the extended portion of the carrier thereof is slidably receivable in a respective groove formed in the upper surface, with the contacts on the extended portion being positionable in electrical contact with at least one of the front electrical contacts and with at least one of the rear electrical contacts of the connector module.

At least the front contact housing has a plurality of slits formed therein. The rear contact holding portion may also include a plurality of slits formed therein. Each front electrical contact is aligned with a corresponding slit in the front contact housing and has a portion thereof which is exposed through the slit so that it is electrically contactable with a wire received by the corresponding slit. If rear slits are included, and if rear electrical contacts are included, the rear electrical contacts have portions thereof exposed through corresponding rear slits so that they, too, may be electrically contactable with a wire received by a corresponding rear slit with which a respective rear contact is aligned.

The upper surface on which the protection modules are mounted and in which the grooves are formed has a depth measured from the exposed portions of the front electrical contacts backward in the direction of the rear contact holder portion which is particularly dimensioned to be equal to or greater than the longitudinal length of each protection module. In this manner, when the protection modules are mounted on the upper surface, the protection modules have no portion thereof overlying the plurality of slits in the front contact housing or overlying the front electrical contact portions which are exposed within the slits so as not to interfere with the placement and removal of wires respectively into and from the plurality of slits and the selective electrical connection with the plurality of front electrical contacts while the protection modules are mounted on the upper surface of the rear contact holder portion or the front contact housing, or both.

Even more preferably, each groove formed in the upper surface on which the protection modules rest is positioned between respective adjacent front electrical contacts and between respective adjacent rear electrical contacts such that portions of the respective adjacent front electrical contacts and portions of the respective adjacent rear electrical contacts are exposed and extend partially into the respective groove therebetween. The carrier of the protection module preferably includes opposite sides on which the exposed electrical contacts are situated for electrically contacting the exposed portions of the respective adjacent front electrical contacts and the exposed portions of the respective adjacent rear electrical contacts.

The connector module may further include an outer housing joined to the front contact housing or the rear contact holder portion, or both, and situated to at least partially overlie the upper surface on which the protection modules rest. The outer housing has a top wall which is preferably spaced apart from the upper surface a distance such that the plurality of protection modules is closely received between the top wall of the outer housing and the upper surface on which the protection modules rest. Such structure helps retain the protection modules in place on the upper surface.

Another form of a connector module and associated protection modules therefor is illustrated, for example, by FIGS. 18–21 of the drawings. The protection modules have a housing defining a cavity therein, a carrier residing in the housing, protection components mounted on the carrier and electrical contacts electrically connected to the carrier. The electrical contacts are in electrical communication with the carrier and protection components mounted thereon. The protection module housing includes a wall, such as a lower wall, that has openings formed through the thickness thereof. The electrical contacts are situated to at least partially extend through the openings formed in the wall of the protection module to define exposed portions of the electrical contacts.

The connector module includes an insulated housing having an outer housing, a front contact housing and a rear contact housing. The outer housing defines an interior chamber in which is at least partially received the front contact housing and the rear contact housing. The outer housing has a top wall, and at least one of the front contact housing and the rear contact housing, or both, includes an upper surface on which is mountable the plurality of protection modules. The top wall of the housing and the upper surface of the front or rear contact housing, or both, define a space therebetween which is dimensioned to receive therein the plurality of protection modules.

The connector module further includes a plurality of front electrical contacts and a plurality of rear electrical contacts. The front contact housing at least partially houses the plurality of front electrical contacts, and the rear contact housing at least partially houses the plurality of rear electrical contacts. Portions of the front electrical contacts and the rear electrical contacts respectively extend from the front contact housing and the rear contact housing and are exposed within the interior chamber of the outer housing to define exposed contact portions. The exposed contact portions of a respective protection module electrical contact is contactable with the exposed contact portions of respective front and rear electrical contacts of the connector module when the respective protection module is received by the interior chamber of the outer housing.

At least the front contact housing has a plurality of slits formed therein. As in the other embodiments described previously, the rear contact housing may also have a plurality of slits formed therein. Each front electrical contact is aligned with a corresponding slit and has a portion thereof which is exposed through the corresponding slit and is, therefore, electrically contactable with a wire received by the corresponding slit. The upper surface on which the protection modules are mountable has a depth measured from the exposed portions of the front electrical contacts backward in the direction of the rear contact housing which is particularly dimensioned to be equal to or greater than (that is, at least equal to) the longitudinal length of each protection module such that, when the protection modules are mounted on the upper surface, the protection modules have no portion thereof overlying the plurality of slits and the front electrical contact portions exposed within the slits. In this manner, the protection modules do not interfere with the placement and removal of wires respectively into and from the plurality of slits and the selective electrical connection with the plurality of front electrical contacts while the protection modules are mounted on the upper surface.

Even more preferably, the top wall of the outside housing may include a plurality of rails partially extending downwardly therefrom and partially into the interior chamber defined by the outer housing. Additionally, each protection module may include a top wall having a recess formed longitudinally therein. A respective rail of the plurality of rails is receivable by a recess of a corresponding protection module to help hold the protection modules in place on the upper surface when the protection modules are slidably received in the interior chamber of the outer housing between the top wall thereof and the upper surface of the front or rear contact housing, or both.

Alternatively, the top wall of the outer housing may include a plurality of first rails extending downwardly therefrom and at least partially into the interior chamber of the outer housing, and the upper surface of the front or rear contact housing, or both, may include a plurality of second rails formed thereon and extending upwardly therefrom and at least partially into the interior chamber of the outer housing. The first and second rails are preferably aligned with each other to at least partially define slots between adjacent first and second rails. Respective protection modules are receivable within corresponding slots defined by adjacent first and second rails within the interior chamber of the outer housing. The first and second rails thus hold the protection modules in place within the connector module.

Furthermore, each protection module may include a first protrusion and a second protrusion. The first and second protrusions are spaced apart a predetermined distance from each other in a direction along the longitudinal axis of the protection module. Additionally, the front contact housing may include at least one ridge which extends outwardly from a surface thereof, such as the upper surface on which the protection modules are mounted, and at least partially transversely across the width of the front contact housing. The first and second protrusions of the protection modules engage the ridge of the front contact housing when the protection modules are inserted into the interior chamber of the outer housing. The first and second protrusions and the ridge together provide an indication of the position of the protection modules with respect to at least the front contact housing and, consequently, the state of electrical communication between the electrical contacts of the protection modules and the front electrical contacts and rear electrical contacts of the connector module.

DETAILED DESCRIPTION OF THE PREFERRED EMBODIMENTS

Figure 1:
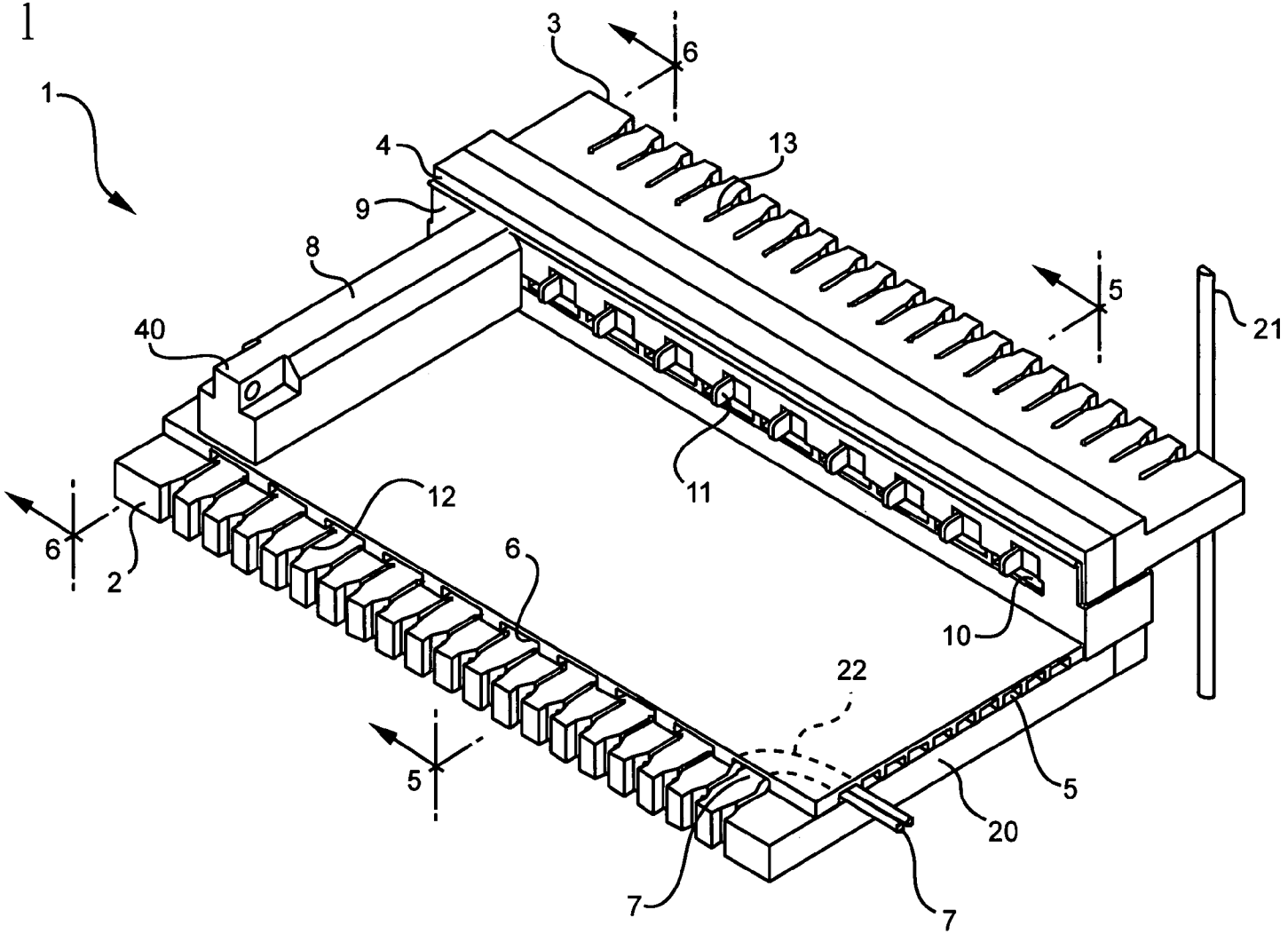
FIG. 1 is a top front isometric view of a connector module and associated protection module formed in accordance with the present invention.
Figure 2:
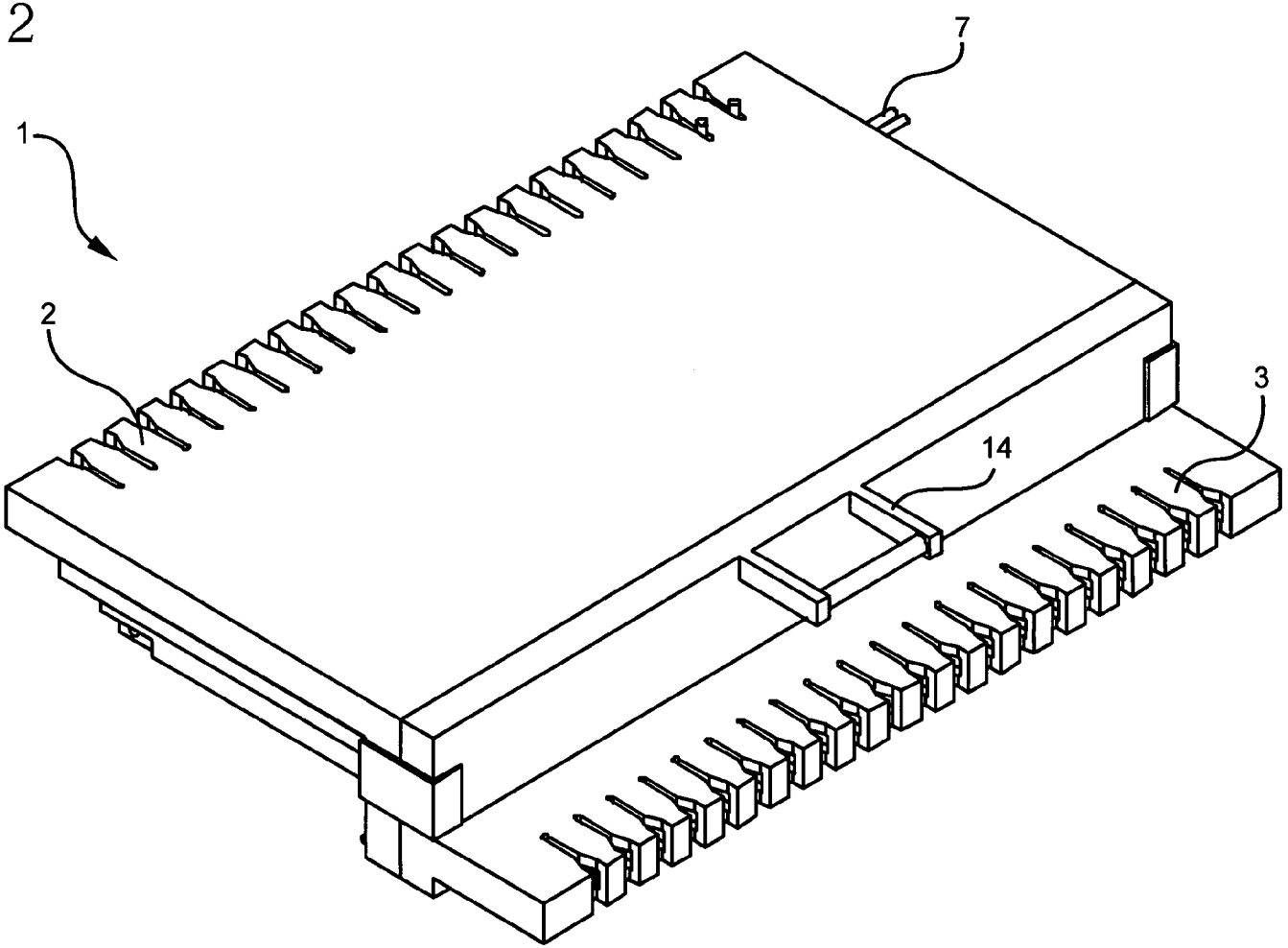
FIG. 2 is a bottom rear isometric view of the connector module shown in FIG. 1.
Figure 5:
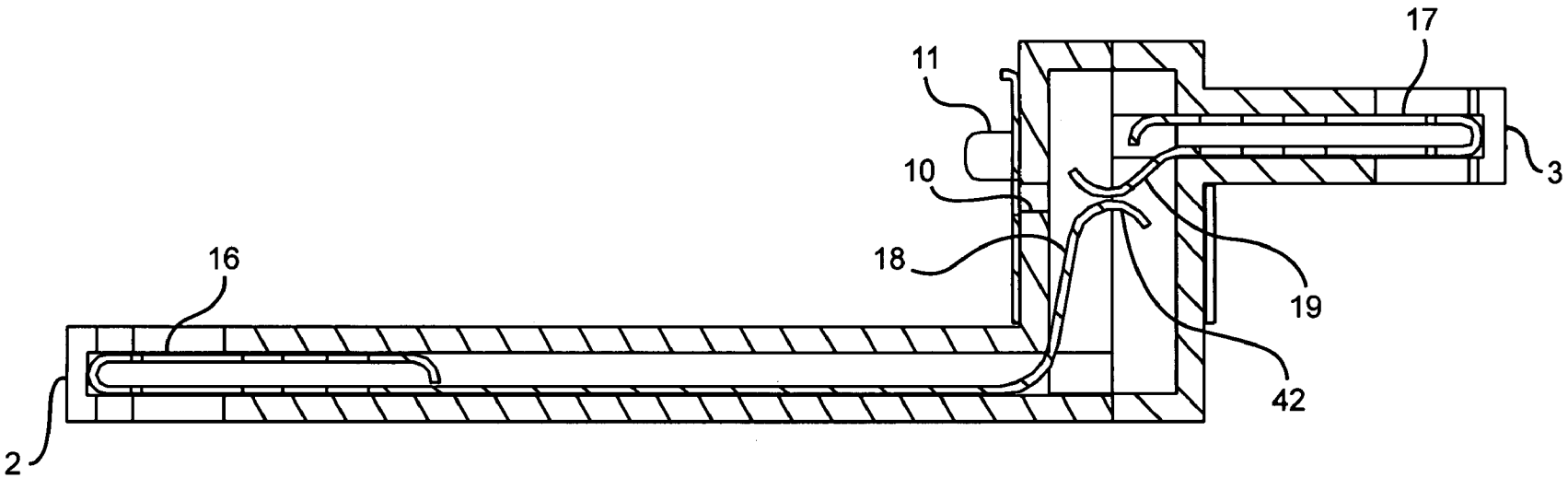
FIG. 5 is a cross-sectional view of the connector module shown in FIG. 1, taken along line 5—5 of FIG. 1.
Figure 7:
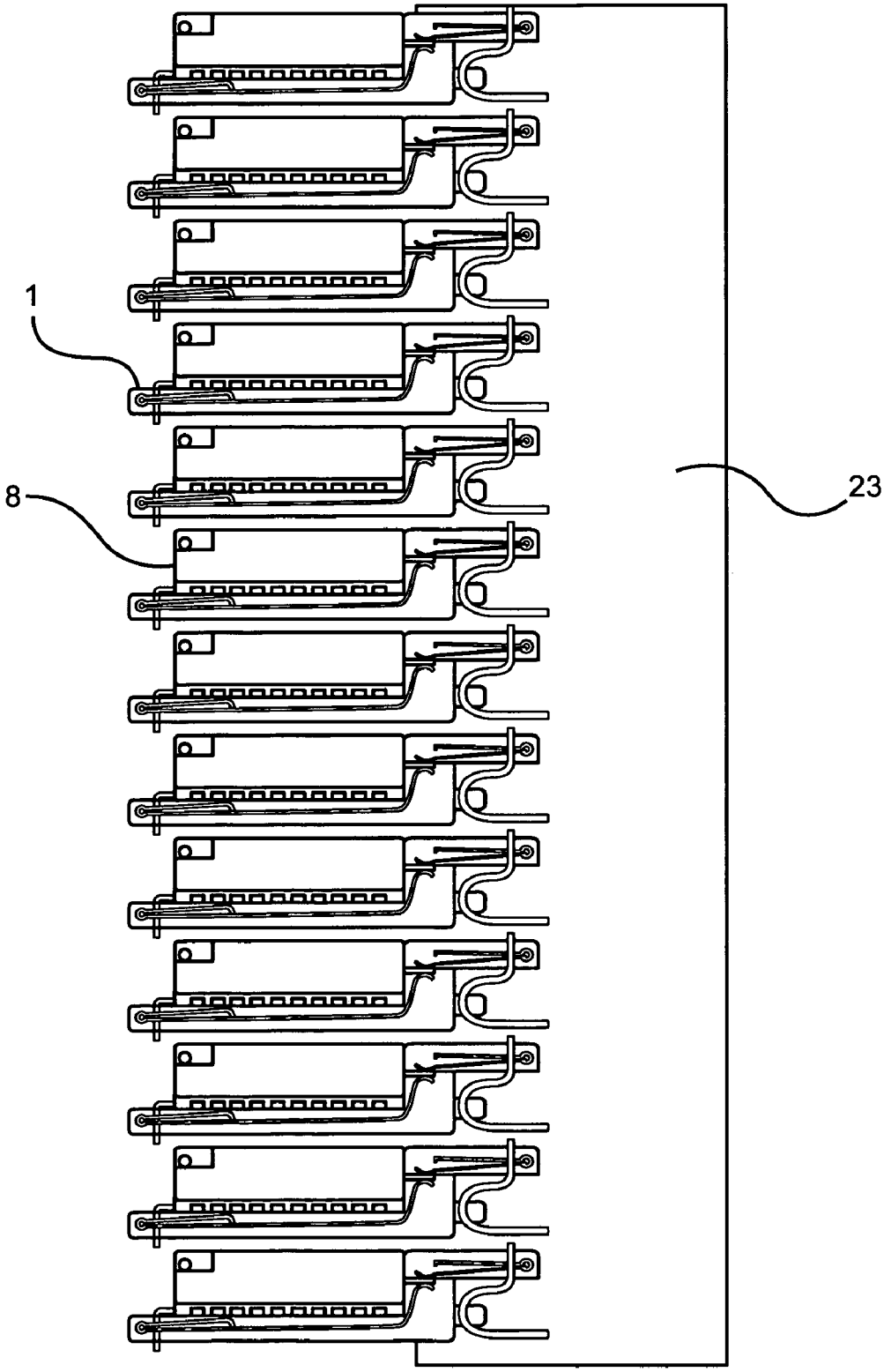
FIG. 7 is a cross-sectional illustration of a plurality of connector modules formed in accordance with the present invention configured to form a connection block.
Figure 8:
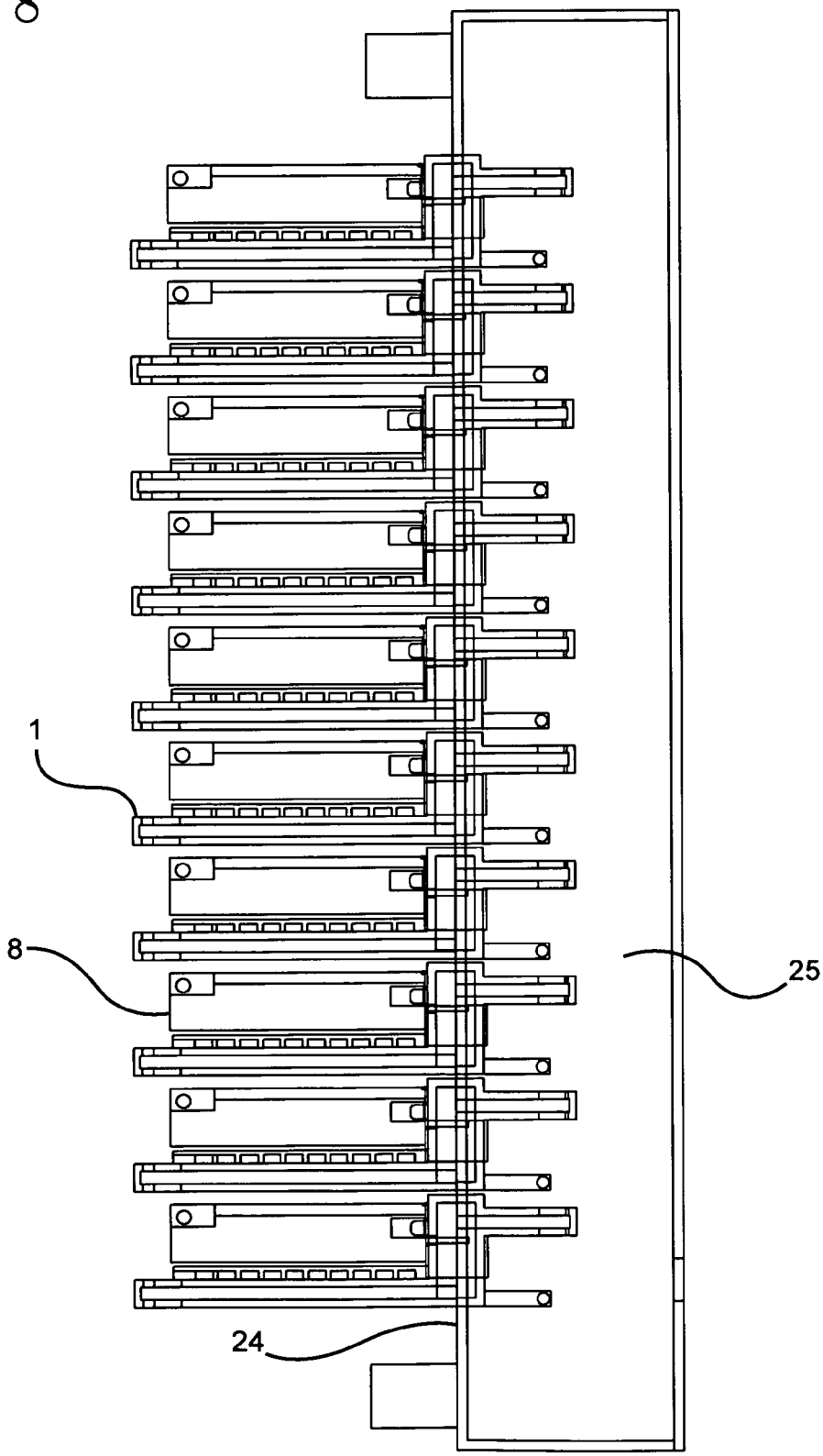
FIG. 8 is a cross-sectional illustration of a plurality of connector modules formed in accordance with the present invention configured to form a building entrance terminal (BET).

Illustrated in FIG. 1 is a connector module 1, formed in accordance with the present invention, which can be inserted onto a mounting frame or through a panel as shown in FIGS. 7 and 8. The module includes a housing, which is made of insulating material such as plastic. The housing includes a body portion 20, which includes a front cap 2 and a rear cap 3 residing in different planes and offset from each other to define a middle portion having a front facing surface 4 recessed from the front cap 2. The caps define the front and rear of the module, each of which has a series of slits 12 and 13 to permit insertion of a wire, items 7 and 21. Each contact is aligned with a slit in one of the caps. Inserted wires make mechanical and electrical contact with the end portion of the contacts 16 and 17 (FIG. 5). Typically, wires 21 from the permanent equipment cable are connected to the rear series of contacts 17 and jumper wires 7 are connected to the front series of contacts 16. A wire support 14 (FIG. 2) can be used to fasten a cable or a plurality of wires to the module to support these wires.

Figure 3:
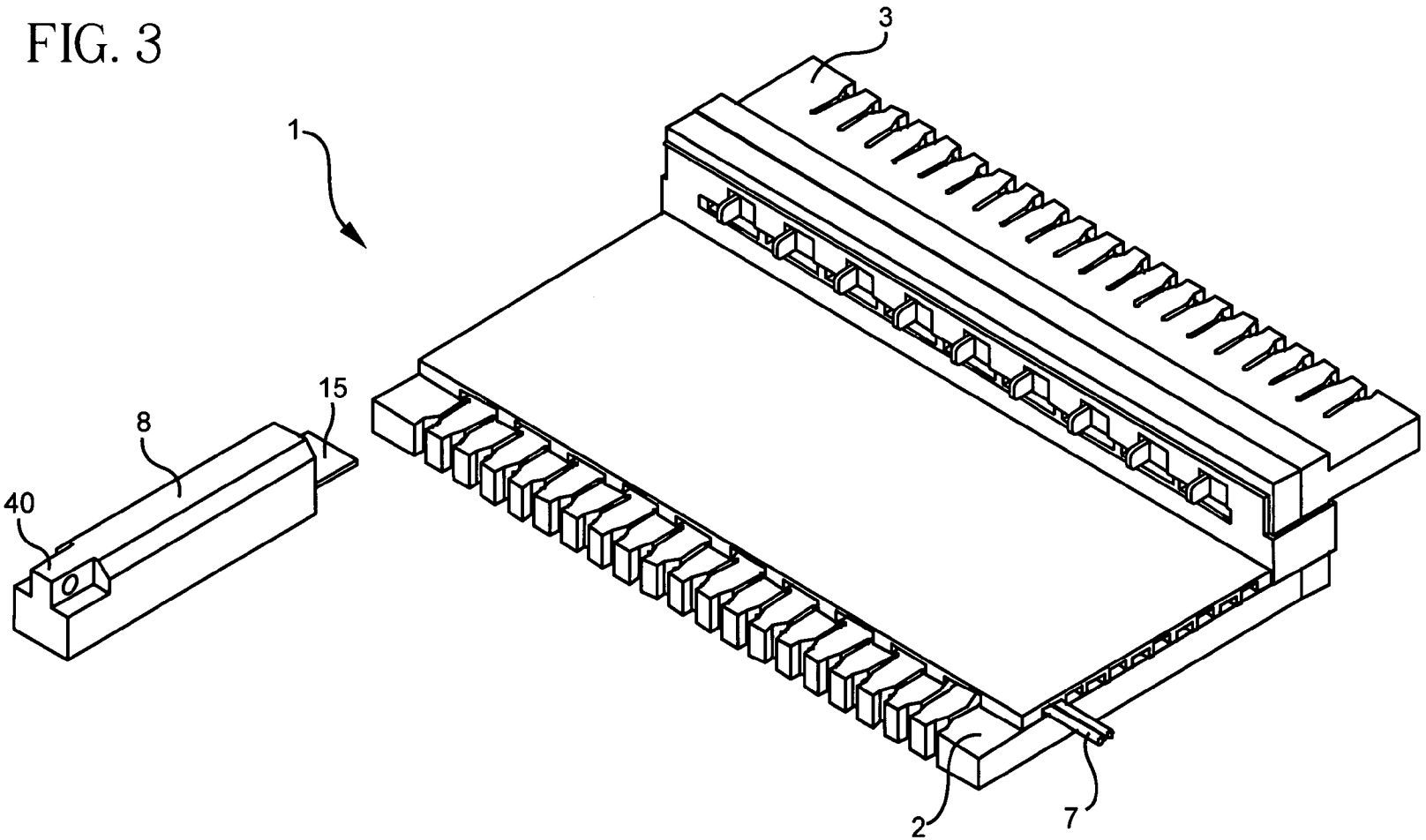
FIG. 3 is a top front isometric view of the connector module shown in FIG. 1 with a protection module formed in accordance with the present invention separated therefrom.
Figure 4:
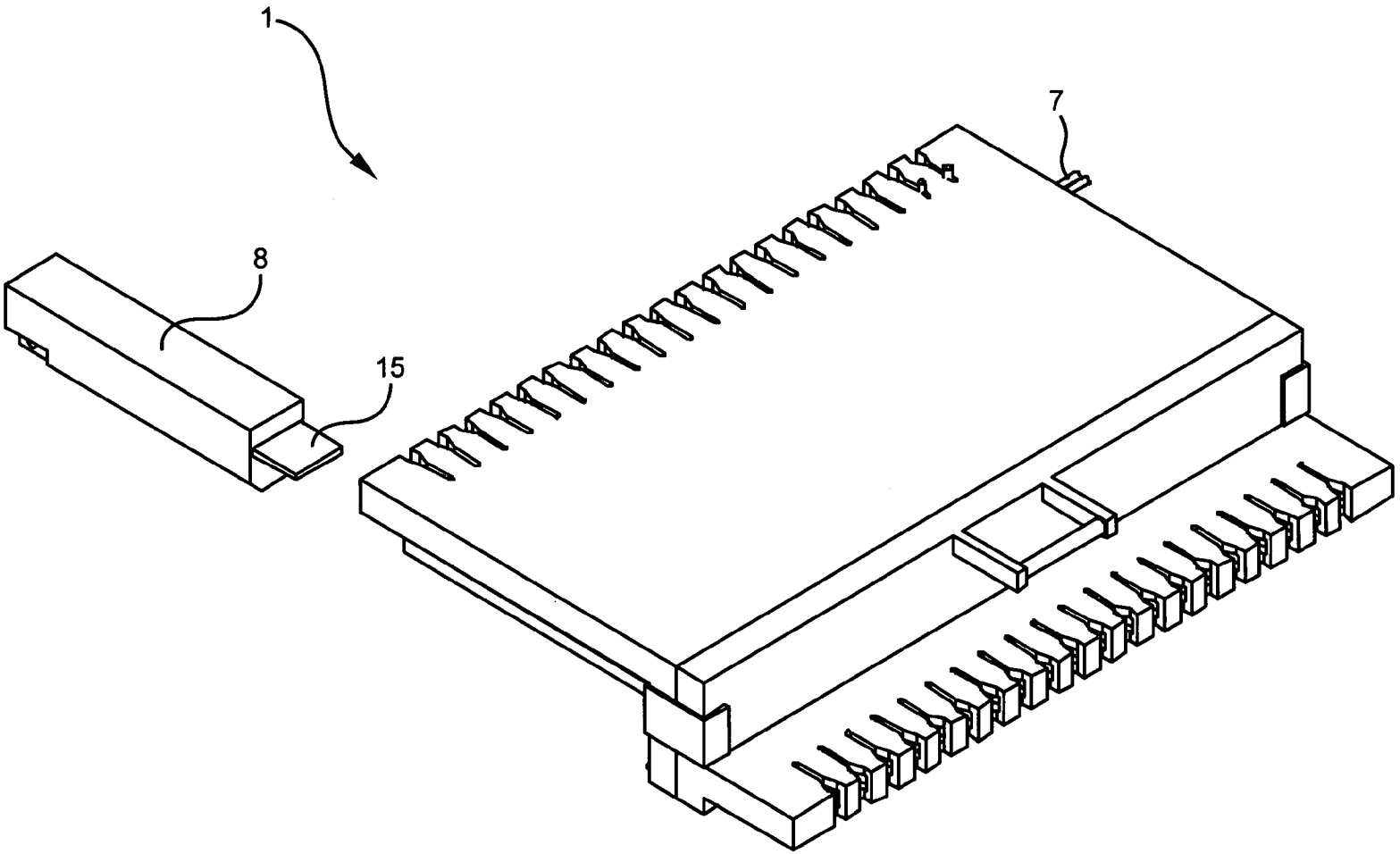
FIG. 4 is a bottom rear isometric view of the connector module shown in FIG. 2, with a protection module formed in accordance with the present invention shown separated therefrom.

A series of protection modules or protectors 8, only one of which is shown in FIGS. 1, 3 and 4, can be installed as required. Protectors can be of the single pair or multiple pair (magazine) type as is known in the art.

Figure 12:
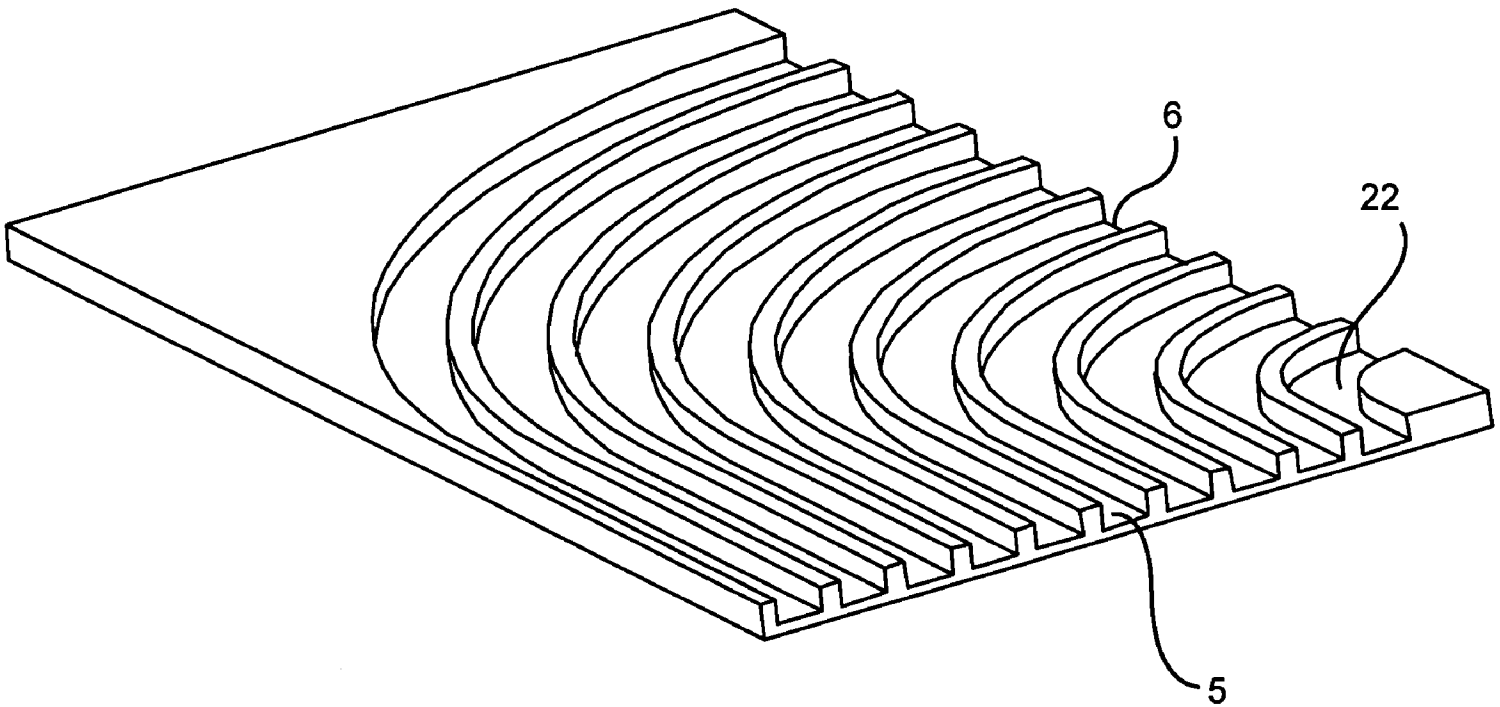
FIG. 12 is a partial cut away, isometric view of the connector module of the present invention, showing the wire guides or channels which route the side-fed telephone wires to their respective connection points.

A series of channels or guides 22 are provided, as more specifically shown in FIG. 12, to guide the wires 7 from the side of the module to the front of the module. The guides 22 keep the wires away from the protector 8 so that the protector can be inserted and removed from the module without the inconvenience of removing or moving the wires. The wires 7 to be inserted into the front series of contacts 16 at front cap 2 are inserted into side openings 5 in the module, which side openings communicate with respective guides 22. A pair of wires 7 is pushed through the guides and exits the guides through a series of openings 6 near the front row of contacts. A separate guide 22 is provided for each pair of wires. Each wire in the pair of wires is terminated to a contact 16 adjacent to the other wire in the pair.

The recessed front facing surface 4 has a series of slits 10 to allow the leads 15 (FIG. 3) of protector 8 to protrude into the housing to make contact with the stem end 18, 19 of the contacts 16, 17, respectively (FIG. 5). This surface 4 is recessed sufficiently from the front cap contacts such that the protection module 8 can be inserted deep enough so as not to interfere with the insertion and removal of the wire 7 from the contact ends 16 and 17 (FIG. 5) and slits 12 and 13 without the inconvenience of removing the module. A lug 40 having a bore through the thickness thereof may be added to the protection module 8 to facilitate removal of the protection module by using the hook of a conventional protection module removal tool commonly used in the industry.

A ground bus 9 is provided when protectors of the type that require grounding are used. Connection tabs 11 are provided on the bus to interface with each protector 8. Each tab 11 preferably protrudes perpendicularly from the major portion of the ground bus and electrically engages a respective protector 8. A magazine type protector may use the ground tabs 11 or use a ground external to the connector module.

Figure 6:
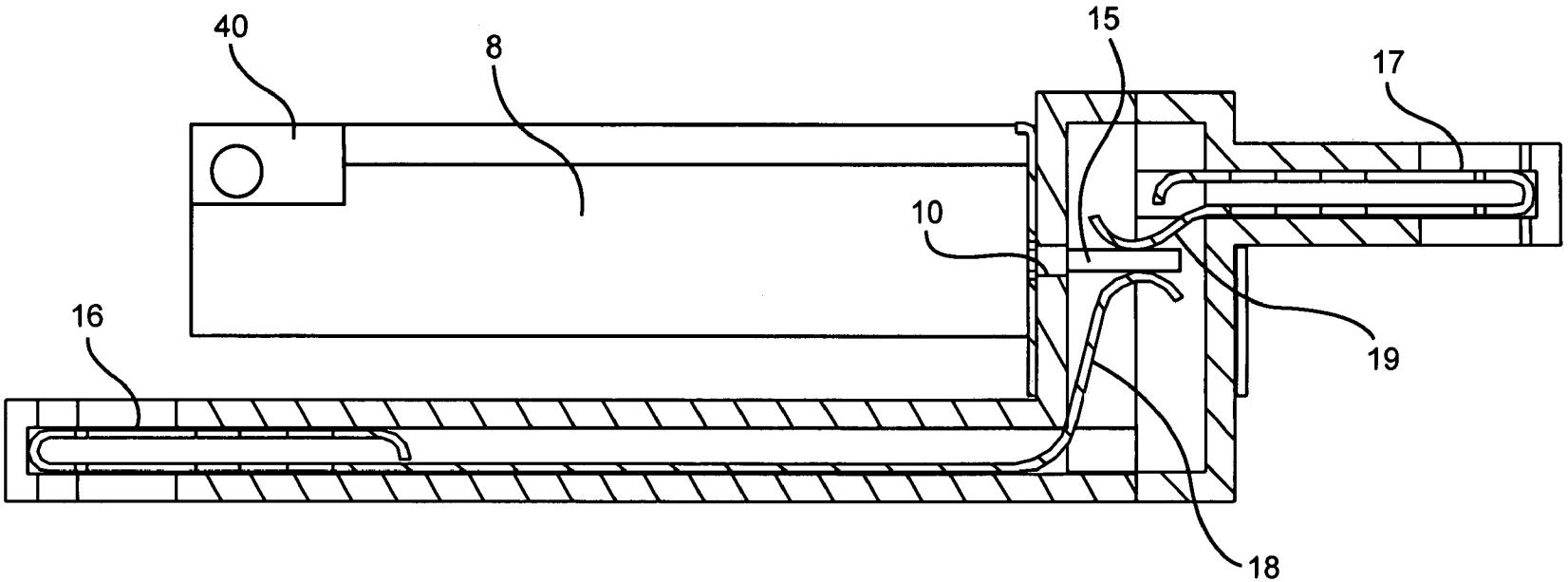
FIG. 6 is a cross-sectional view of the connector module and associated protection module shown in FIG. 1, taken along line 6—6 of FIG. 1.

The circuit is complete between the wire 7 connected to the front series of contacts 16 and the wire 21 connected to the rear series of contacts 17 through a series of mechanical and electrical contact points 42 (FIG. 5) when protectors are not installed. The circuit is complete between the wire 7 connected to the front series of contacts and the wire 21 connected to the rear series of contacts through a series of mechanical and electrical contact points between the protector leads 15 (FIG. 6) and the stem ends 18, 19 of the contacts 16, 17, respectively, when the protectors are installed.

FIG. 7 shows a plurality of connector modules 1 (also shown with protection modules 8 in place) configured together on a backmount frame 23 to form what is know in the art as a connection block or connector block.

FIG. 8 shows a plurality of connector modules 1 (also shown with protection, modules 8 in place) configured together through a panel 24 of an enclosure 25 to form what is known in the art as a building entrance terminal (BET).

Figure 9:
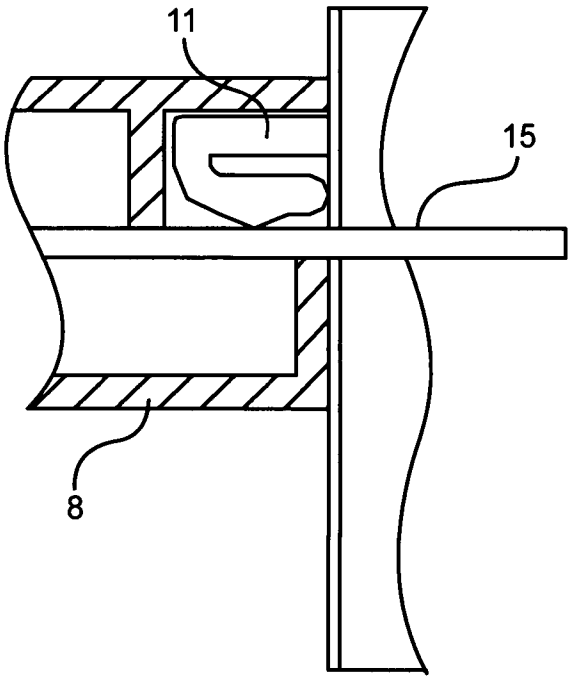
FIG. 9 is a cross-sectional illustration of a connector module and associated protection module formed in accordance with the present invention and further illustrating an alternate configuration for a ground connection used in the connector module of the present invention.

FIG. 9 shows an alternate configuration for the ground connection tab 11 engaging lead 15 of the protection module 8. This connection tab is shaped like a hook with a resilient free end that contacts the protection module lead 15 to ensure a good electrical connection.

Figure 10:
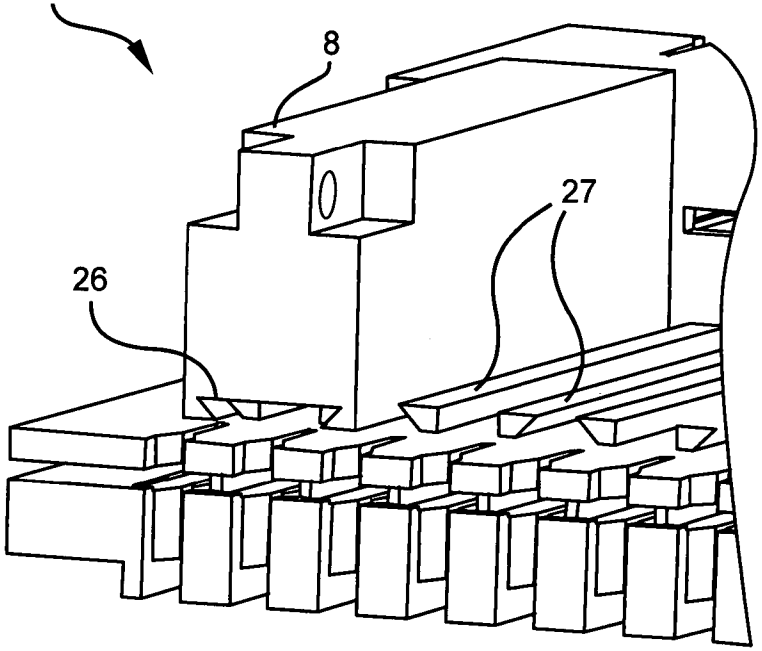
FIG. 10 is a partial isometric view of an alternative embodiment of the connector module of the present invention, illustrating mating projections and recesses on the protection module and connector module to help guide the protection module in place on the connector module.

FIG. 10 illustrates another form of the connector module 1 and protection module 8 of the present invention. The connector module may include a series of parallel, spaced apart projections 27, preferably dovetail in cross-section, formed on the upper surface of body portion 20 (on the side adjacent to recessed surface 4). The dovetail projections shown in FIG. 10 may be split to form two halves, each having one of the two side faces forming the dovetail. Each protection module 8 may correspondingly include a recess 26, preferably dovetail in cross-section, formed in its lower surface and extending longitudinally along its length. The projection 27 (or half projections) of the connector module is received by a corresponding recess 26 formed in the protection module as the protection module 8 is inserted onto the connector module 1. The mating projections and recesses of the connector module and protection modules help guide each protection module in its place on the connector module so that lead 15 of the protection module is properly aligned with and received by a corresponding slit 10 formed in the recessed front facing surface 4, and so that each ground connection tab 11 of the connector module is properly aligned with and received by a corresponding opening 28 formed in the end face of the protection module's housing.

Although the projection 27 and recess 26 may be rectangular in cross-section, or having a different shape, it is preferred that they are dovetail in shape (as shown), "T"-shaped or the like so that the protection modules are securely retained in place on the connector module when mounted thereon. Also, it is envisioned to be within the scope of this invention to reverse the locations of the projections and recesses, such that the recesses 26 are formed in the body portion 20 of the connector module 1 and the projections 27 are formed on the protection modules 8.

Figure 11:
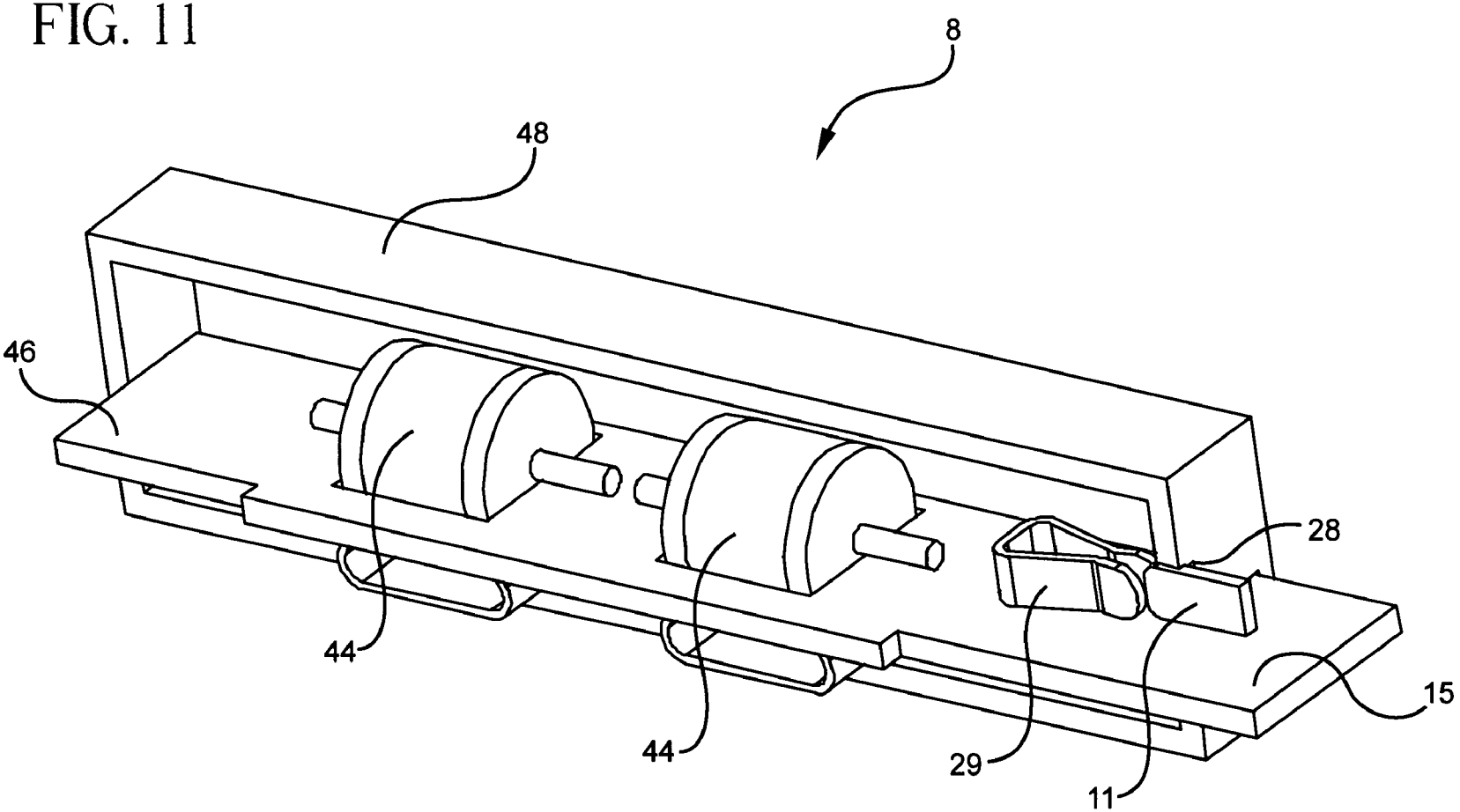
FIG. 11 is a partial cut away, isometric view of a protection module formed in accordance with the present invention, shown mating with a connection tab of the connector module.

FIG. 11 shows the inside of the protection module 8 formed in accordance with the present invention. One or more gas discharge tubes 44 (or other devices) are mounted on printed circuit board 46 situated within the housing 48 of the protection module. Electrical contact 29 with resilient leaves is electrically in contact with the printed circuit board (and the gas discharge tubes 44) and makes contact with ground connection tab 11 of connector module 1 through opening 28 formed in an axial end face of the housing 48. A portion of the printed circuit board 46 preferably extends from the end face of the housing through another opening formed therein to define lead 15 which is received in slit 10 of the connector module 1 and which engages resilient electrical contact portions 18, 19 therein.

A further embodiment of a connector module and an associated protection module formed in accordance with the present invention is illustrated by FIGS. 13–17. More specifically, the connector module 50 uses a protection module 52 having electrical contacts 64 which protrude below the body or housing of the protection module. Each protection module slides into a respective groove 61 of a plurality of parallel grooves formed in a surface of the main body (also referred to herein as the rear contact holder portion 59 and/or a front contact housing 60) of the connector module 50. The connector module 50 includes sets of electrical contacts, 56 and 66, 62 and 65, 63 and 67 and 57 and 68, which electrical contacts face each other and make contact with corresponding electrical contacts on the protection module 52.

Figure 17C:
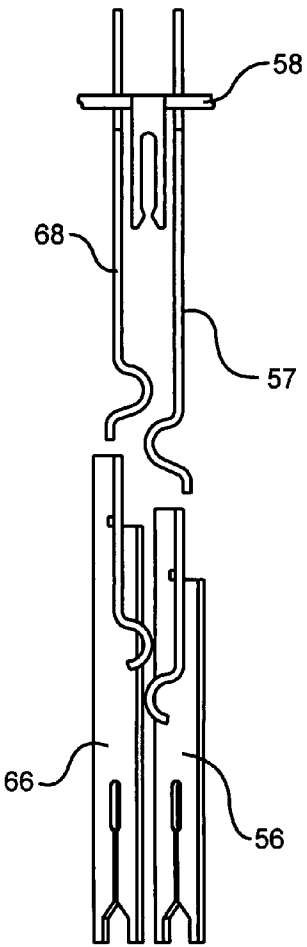
FIGS. 17A, 17B and 17C are top plan views of alternative electrical contact arrangements for the connector module shown in FIG. 13.
Figure 17B:
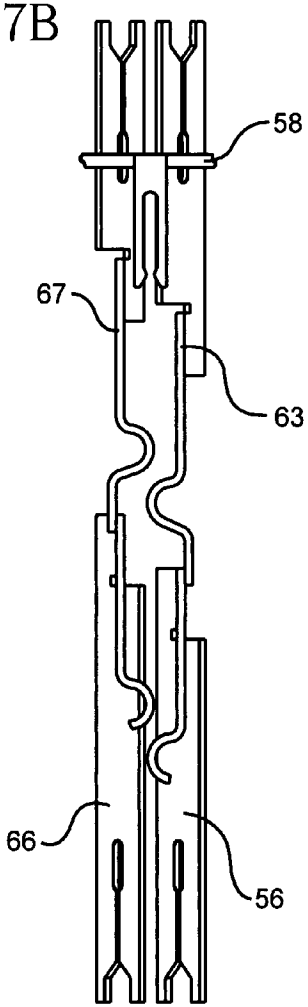
Figure 17A:
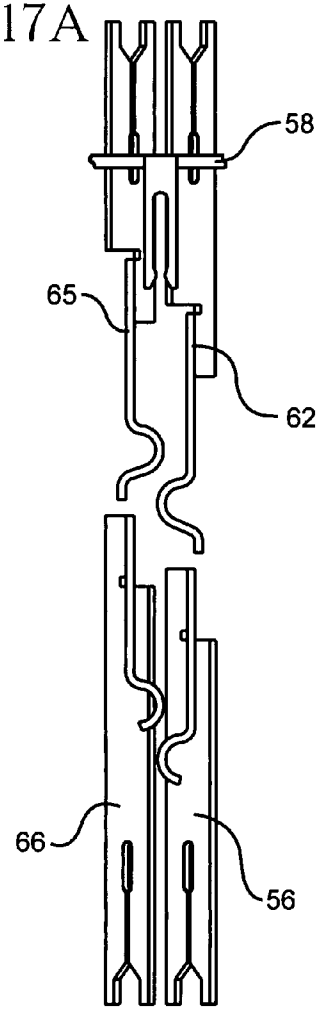

More specifically, and with reference now to FIGS. 17A, 17B and 17C of the drawings, it will be seen that the electrical contacts of the connector module 50 can be insulation displacement contacts (IDC), or configured for soldering to a printed circuit board or for wire wrapping. Furthermore, the contacts may be configured to be normally open or normally closed through the protection module 52. With reference to FIG. 17A, front contacts 56 and 66 are shown as IDC-type contacts for the jumper side of the connector module 50. Contacts 62 and 65 of the cooperating set of contacts are shown as normally open, IDC-type contacts. When the protection module 52 is slid into a respective groove 61 in the connector module, bent portions of contacts 56 and 66, and of contacts 62 and 65, of the connector module 50, which bent portions are directed inwardly of the groove 61 and are exposed therein, engage corresponding spaced apart electrical contacts 64 (FIG. 15) of the protection module 52. Thus, with the two pair of electrical contacts illustrated by FIG. 17, an electrical path is provided from contact 66 to contact 65 through the protection module 52, and similarly, an electrical path is provided between contact 56 and contact 62 through the protection module 52, when the protection module is fully received by its respective groove 61 formed in the connector module 50, and inserted between the connector module contacts 56 and 66, and 62 and 66.

In the arrangement of connector module electrical contacts illustrated by FIG. 17B, electrical contacts 63 and 67 are shown as normally closed IDC-type contacts, with contact 67 in electrical contact with contact 66, and with contact 63 in electrical contact with contact 56, without a protection module 52 being received between the electrical contacts. When a protection module 52 is received by a respective groove 61 formed in the connector module 50, it is slid between contacts 56 and 66 and contacts 63 and 67. Bent portions of the contacts 63 and 67 and 56 and 66 are directed inwardly toward the groove 61 and exposed therein so that they will engage and electrically communicate with corresponding spaced apart contacts 64 (FIG. 15) on the protection module 52. As in the contact arrangement shown in FIG. 17A, the protection module 52 displaces contacts 56, 63, 66 and 67 from their original positions (when no protection module is positioned between them) and moves contacts 63 and 67 out of respective electrical communication with contacts 56 and 66, thus interrupting the circuit between the contacts. An electrical path between contacts 56 and 63 and between contacts 66 and 67 is now provided through the protection module 52.

FIG. 17C illustrates two pairs of cooperating contacts 56 and 57, and 66 and 68, in a normally open configuration, in the same manner as described with respect to the contacts 56, 66, 62 and 65 shown in the embodiment of FIG. 17A, except that contacts 57 and 68 are configured as solder or wire wrap contacts. The operation of these contacts would be the same as described previously with respect to the pairs of contacts illustrated by FIG. 17A.

It should be further noted that, preferably, the contacts 56, 66, 62, 65, 63, 67, 57 and 68 are angled at preferably a 45 degree angle with respect to the plane in which the main body (i.e., the rear contact holder portion 59 and/or the front contact housing 60) of the connector module 50 resides.

Returning now to FIGS. 13, 14A and 14B of the drawings, it will be seen that the connector module 50 includes an insulating housing that preferably includes a rear contact holder portion 59, which receives and holds in place the rear set of contacts 62, 65, 63, 67, 57 and 68, a front contact housing 60 which houses and holds in place the front set of contacts 56 and 66, and an outer housing 51 which is preferably box-shaped with an open front face and which may be snap-fitted or secured onto opposite lateral sides of the rear contact holder portion 59 and/or the front contact housing 60 joined to the rear contact holder portion 59 (together defining the main body). The insulating housing of the connector module 50 may be formed as separate parts or may be integrated into one single part. If IDC-type contacts are used for both the front and rear contacts 56, 66, 63, 67, 62 and 65, such as illustrated by FIGS. 17A and 17B, then separate rear contact holder portion 59 and front contact housing 60 are preferably used. When outer housing 51 is mated to rear contact holder portion 59 and/or front contact housing 60 in an overlying relationship, it defines between the upper surface of the contact holder portion 59 and/or the upper surface of the front contact housing 60 in which the grooves 61 are formed and its top wall, back wall and side walls an open pocket for receiving the protection modules 52 therein when the protection modules are received by respective grooves 61 formed in the connector module 50. More specifically, the spacing between the top wall of the outer housing 51 and the upper surface of the rear contact holder portion 59 and/or the front contact housing 60 in which the grooves 61 are formed is dimensioned to be equal to or slightly greater than the height of the protection module 52 so that the top wall of the outer housing 51 engages the top surface of the protection module to hold each protection module in place in a respective groove 61 in which it is received.

Figure 14A:
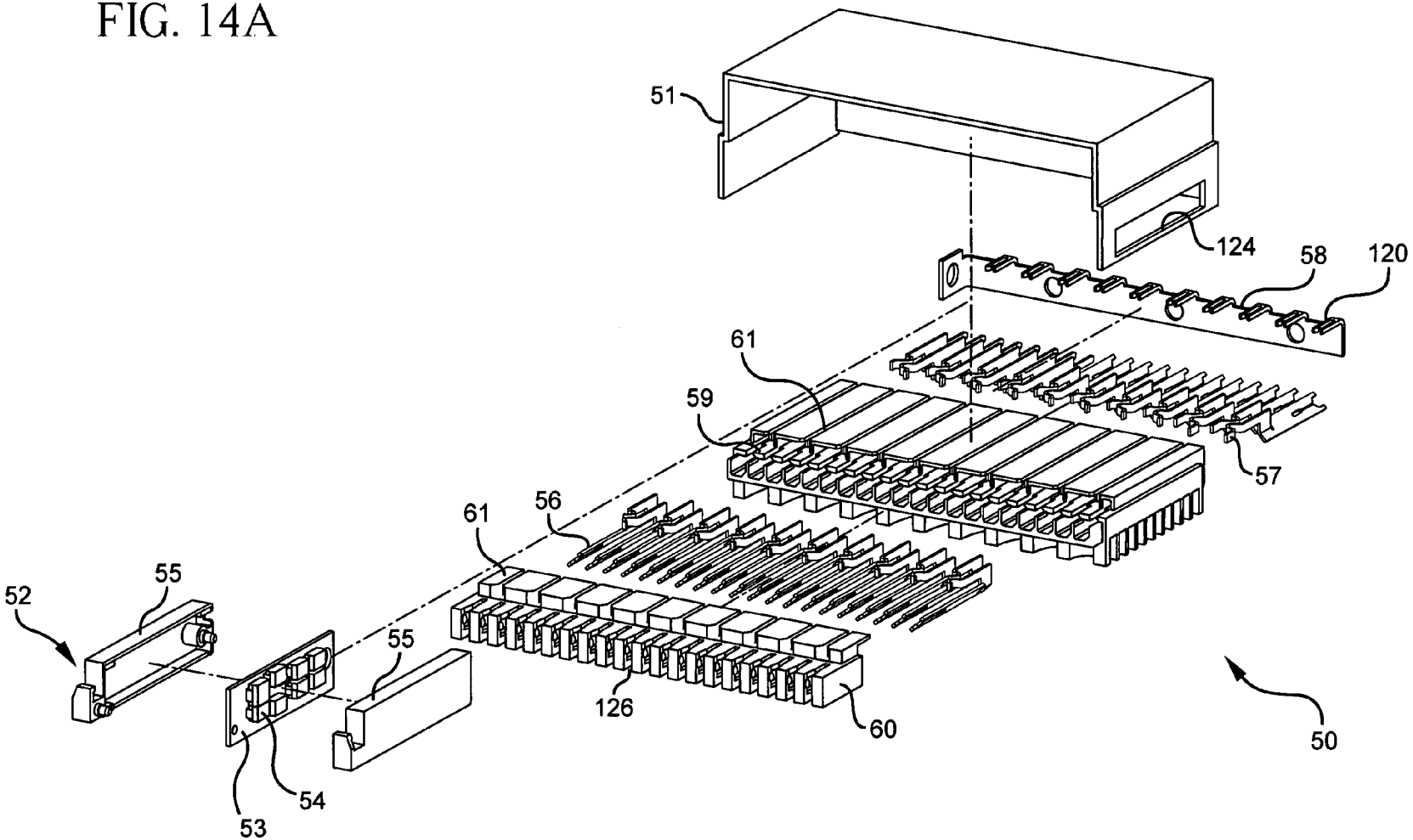
FIG. 14A is an exploded top isometric view of the connector module and protection module shown in FIG. 13.
Figure 14B:
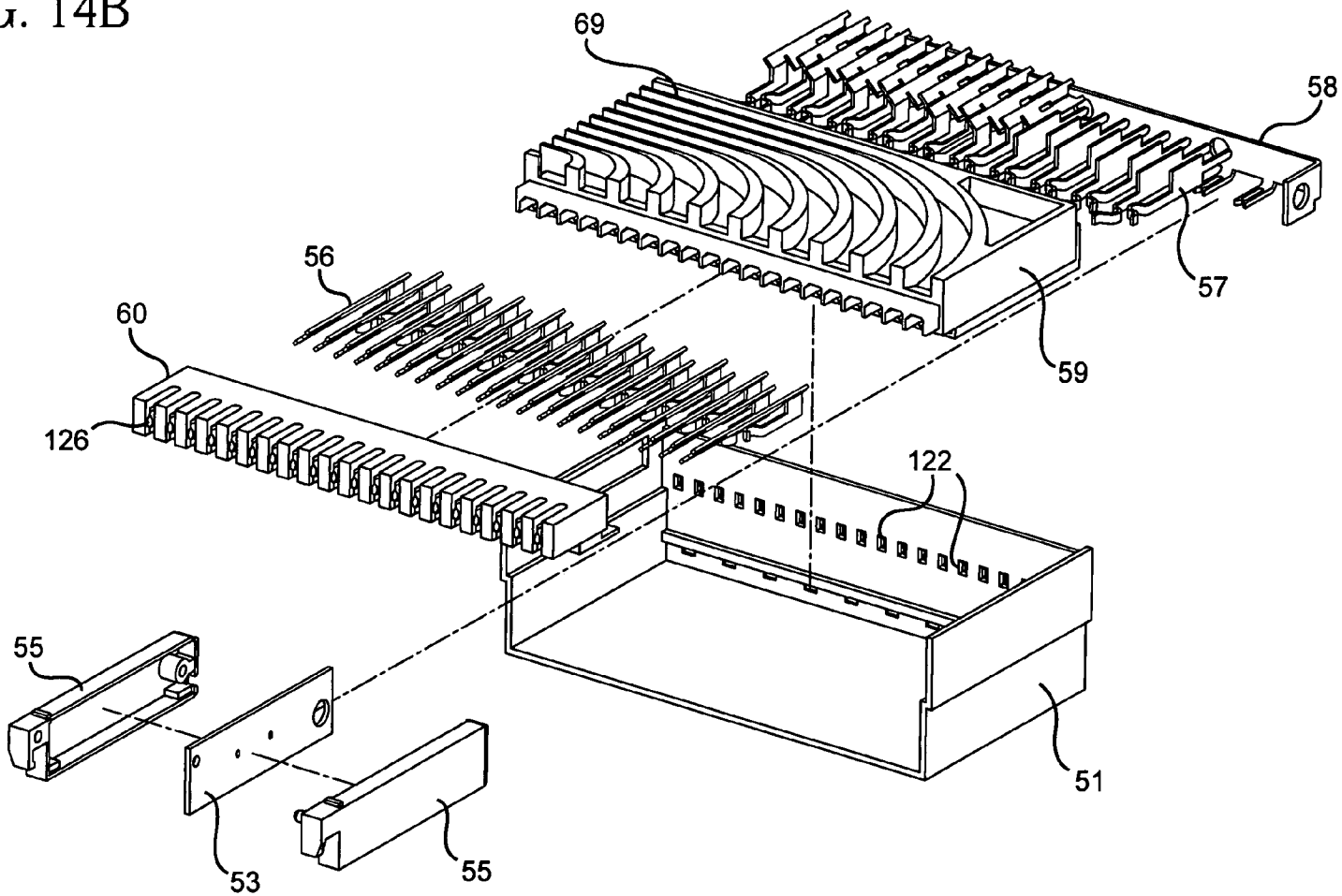
FIG. 14B is an exploded bottom isometric view of the connector module and protection module shown in FIG. 13.

As can be seen from FIGS. 14A and 14B of the drawings, an electrical ground 58 is provided as a primarily planar member having forked tabs 120, pins or the like affixed thereto which protrude normally from the planar member in the direction of the grooves 61 and protection modules 52 received thereby so that the forked tabs or pins may make electrical contact with a corresponding contact 102 (FIG. 15) of the protection module 52. More specifically, each forked tab 120 has a space between the extending forked portions thereof which at least partially receives and makes contact with an electrical ground contact 102 of the protection module.

The ground 58 for the protection modules 52 is located in the rear of the connector module 50, either inside the outer housing 51 or, more preferably, on the outside of the back wall thereof, with the formed tabs passing through corresponding openings 122 formed through the thickness of the back wall and into the open pocket of the connector module to electrically engage ground contacts 102 of the protection modules 52. Each protection module 52 is inserted from the front of the connector module 50 through the open face of the outer housing 51. The jumper wires are inserted into the wire guides 69 (see FIG. 14B) which are similar in structure to the embodiments described previously and shown in FIGS. 1 and 12, in particular. The side openings, which together with the front openings communicate with the guide channels, are aligned with a slot 124 formed through the thickness of a side wall of the outer housing 51 to allow wires to be inserted therethrough.

Figure 15:
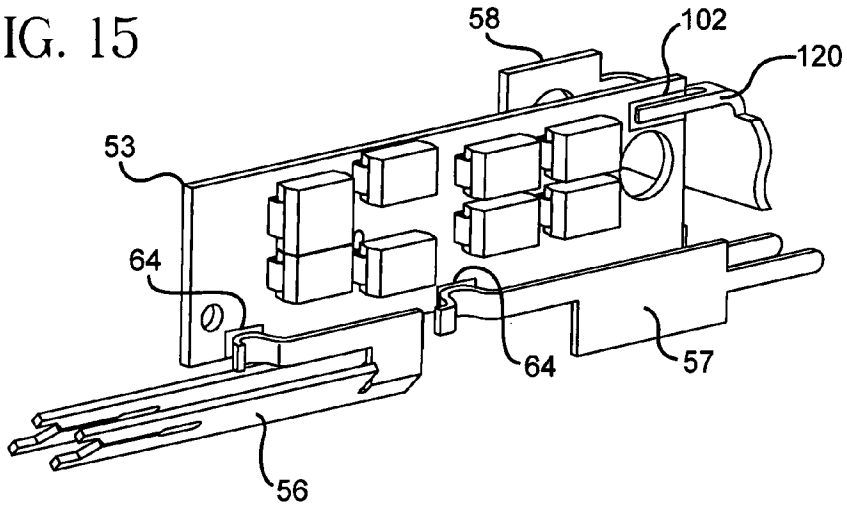
FIG. 15 is a partial isometric view of portions of the connector module and protection module formed in accordance with the present invention and illustrates the interface between the protection module and the connector module.
Figure 16:
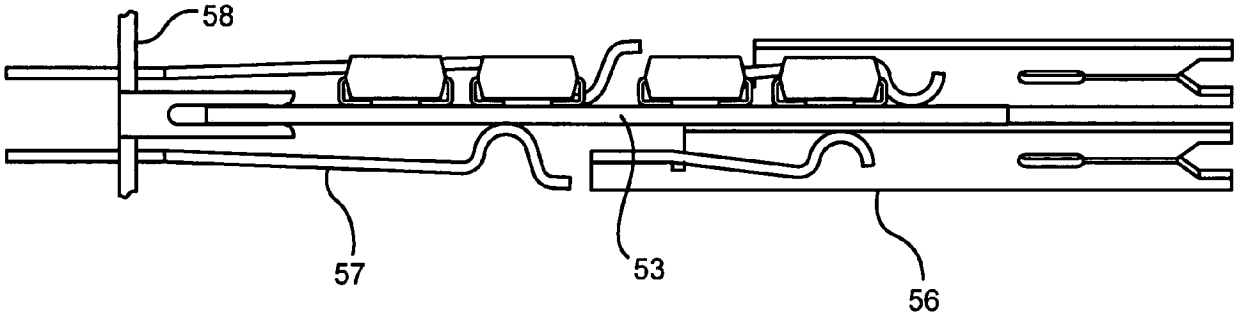
FIG. 16 is a top plan view of portions of the connector module and protection module shown in FIG. 15.

As shown in FIGS. 14A and 14B of the drawings, the protection module 52 includes a carrier, substrate or printed circuit board 53, various electrical or mechanical protection components 54 mounted thereon, and a housing 55 which is shown as including matable left and right half portions. The carrier 53 for the protection module components may be a printed circuit board, as mentioned previously, or a lead frame suitable for holding and electrically connecting the protection components 54 to one another and to the ground 58 (through contact 102) and the contacts 56, 57, 62, 63, 65, 66, 67 and 68 (through contacts 64). It should be noted that, although FIG. 15 shows contacts 64 and 102 on one side of carrier 53, these contacts are similarly located on the opposite side of carrier 53 in preferably the same locations as on the first-mentioned side depicted in FIG. 15.

As in the previous embodiment described in relation to FIGS. 1–12, this present embodiment of the connector module may include a plurality of front slits 126 and/or rear slits (not shown), with portions of the front and/or rear contacts being exposed in corresponding slits. Each slit receives a respective jumper wire which is inserted into it for making contact with the exposed portion of the electrical contact aligned with the slit. Also, as with the previously described embodiment, the upper surface of the connector module main body on which the protection modules rest and in which the grooves are formed is dimensioned in depth measured from the portions of the front contacts exposed in the slits backward toward the inside surface of the back wall of the outer housing 51 to be equal to or greater than the longitudinal length of each protection module 52 so that no portions of the protection modules overlie the slits or exposed contacts therein so as not to interfere with the insertion and removal of wires respectively into and from the slits and front electrical contacts while the protection modules 52 are properly mounted on the connector module 50.

Figure 13:
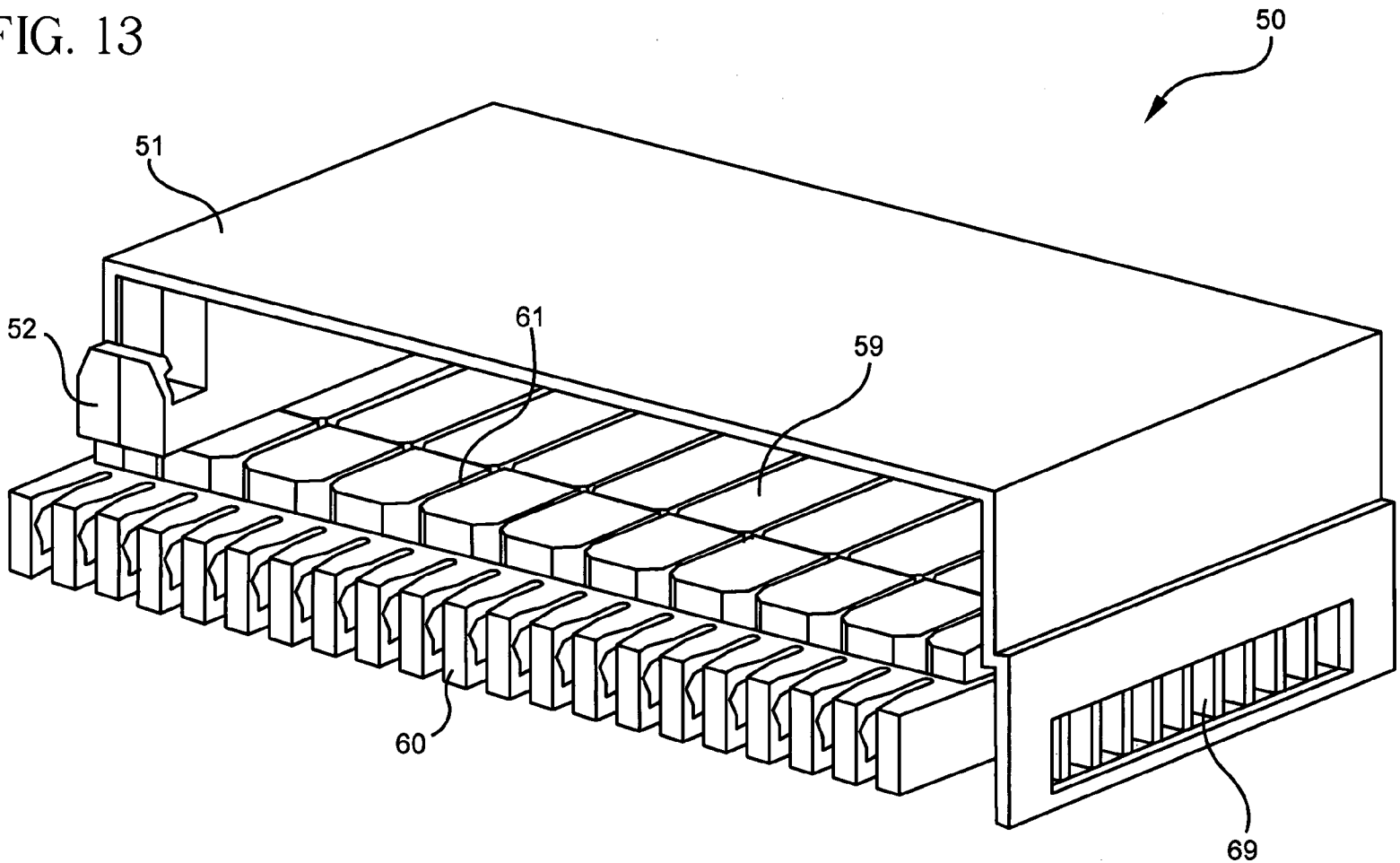
FIG. 13 is an isometric view of another embodiment of a connector module formed in accordance with the present invention, and also illustrating a cooperating protection module also formed in accordance with the present invention.

It should be further noted that only one connector module 50 is illustrated by FIGS. 13, 14A and 14B. However, multiple insulating housings as described previously with respect to connector module 50 may be integrated to form a higher pair count connecting block.

A further embodiment of a connector module 70 and cooperating protection module 72, formed in accordance with the present invention, is illustrated by FIGS. 18–21 of the drawings. In this embodiment, the connector module 70 accomplishes the service objectives without using integrated wire guides.

The connector module 70 includes an insulated housing having an outer housing 71, a front contact housing 83 and a rear contact housing 84. More specifically, the outer housing 71 is rectangular or box-shaped and includes preferably parallel top and bottom walls and opposite lateral side walls perpendicularly affixed to the top and bottom walls. The outer housing 71 further includes a rear wall having a transverse lower opening through which is at least partially received the rear contact housing 84, and an open front face opposite the rear wall. The front contact housing 83 is received through the open front face of the outer housing 71 defined by the edges of the top and bottom walls and the lateral side walls and is at least partially received within a pocket or chamber defined interiorly of the outer housing 71 by the top and bottom walls, the rear wall and the opposite lateral side walls. The opposite lateral side walls may include open slots 128 formed therein and extending from the front face and the rear wall inwardly of the outer housing, which slots closely receive shoulders 130 formed on the lateral sides of the front contact housing 83 and the rear contact housing 84. The slots and shoulders cooperate to ensure that the front contact housing 83 and the rear contact housing 84 are properly received and held in place by the outer housing 71. Alternatively, an internal rib 110 (FIG. 20A) may be formed on the inside surface of each lateral side wall of the outer housing 71 to extend partially inwardly of the pocket or chamber, which ribs are preferably spaced a predetermined distance above the bottom wall of the outer housing 71. In such a version of the connector module having ribs, the front contact housing 83 and the rear contact housing 84 are at least partially received between the bottom wall of the outer housing 7.1 and each rib to ensure that the front contact housing 83 and rear contact housing 84 are held in place within the outer housing 71. The insulating housing of the connector module 70 can be formed of the outer housing 71, front contact housing 83 and rear contact housing 84 either as separate parts or integrated into a single unitary part.

Figure 18:
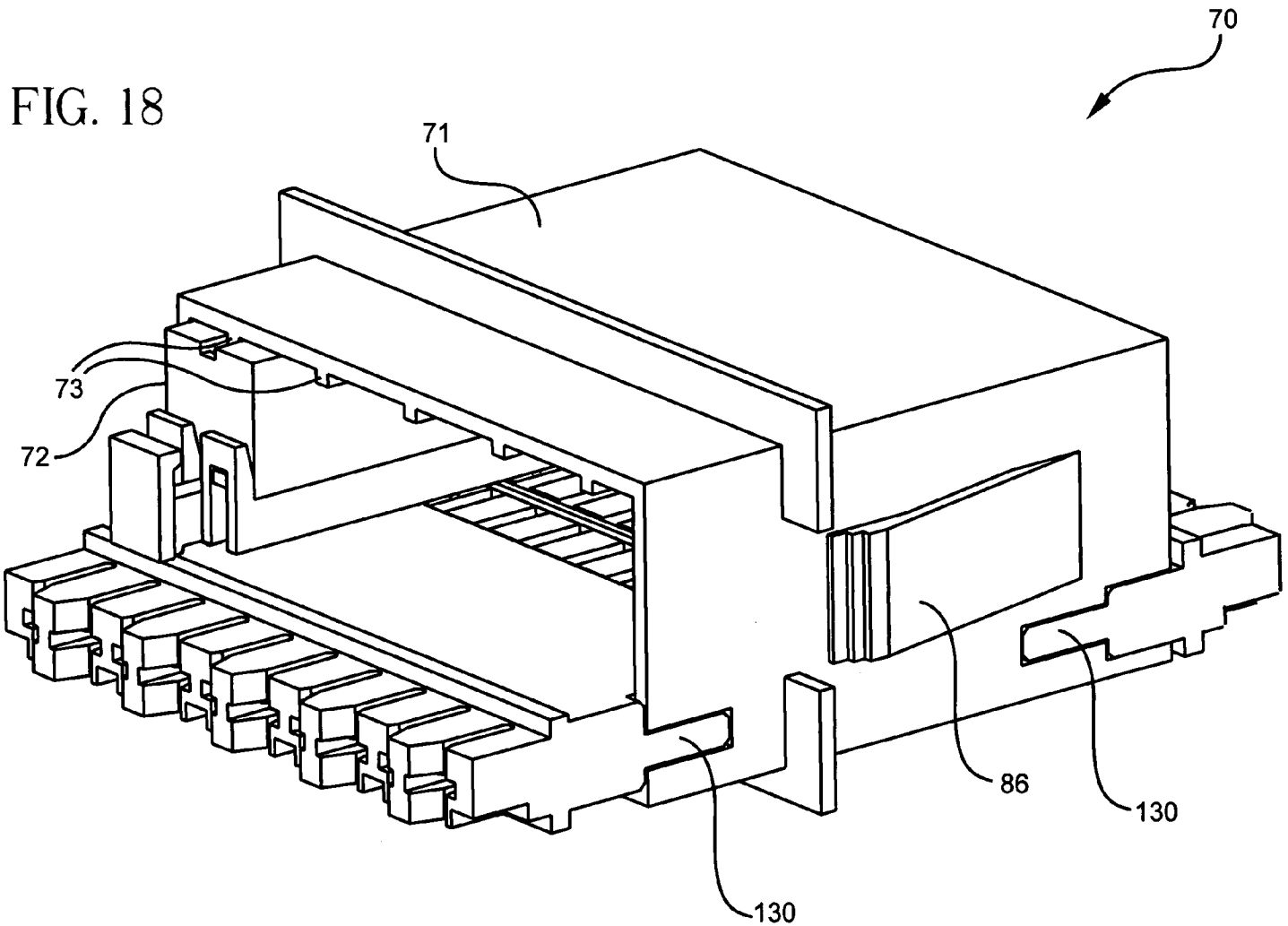
FIG. 18 is a front isometric view of an alternative embodiment of the connector module and associated protection module formed in accordance with the present invention.
Figure 20A:
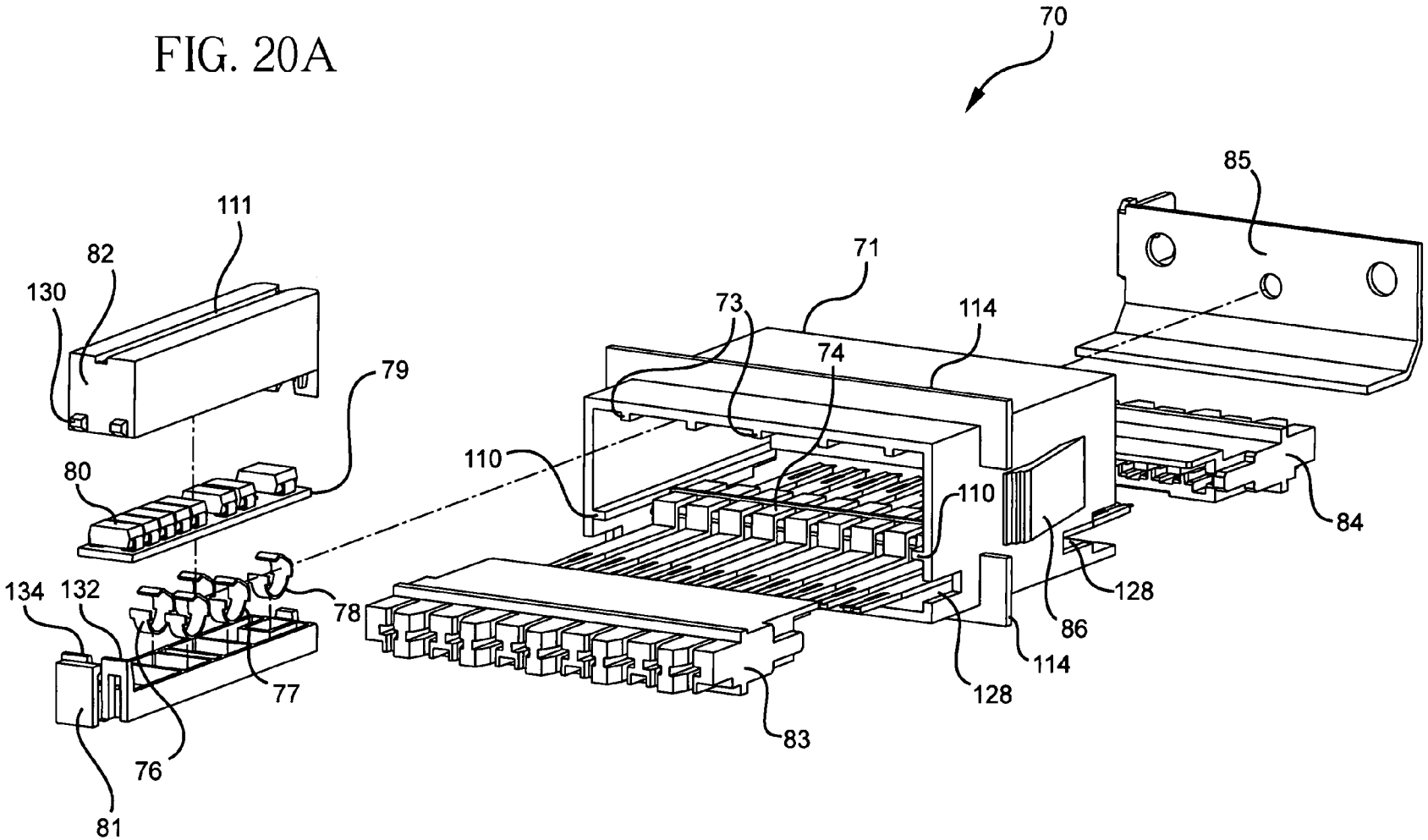
FIG. 20A is an exploded isometric view of the connector module and protection module illustrated by FIG. 18.
Figure 20B:
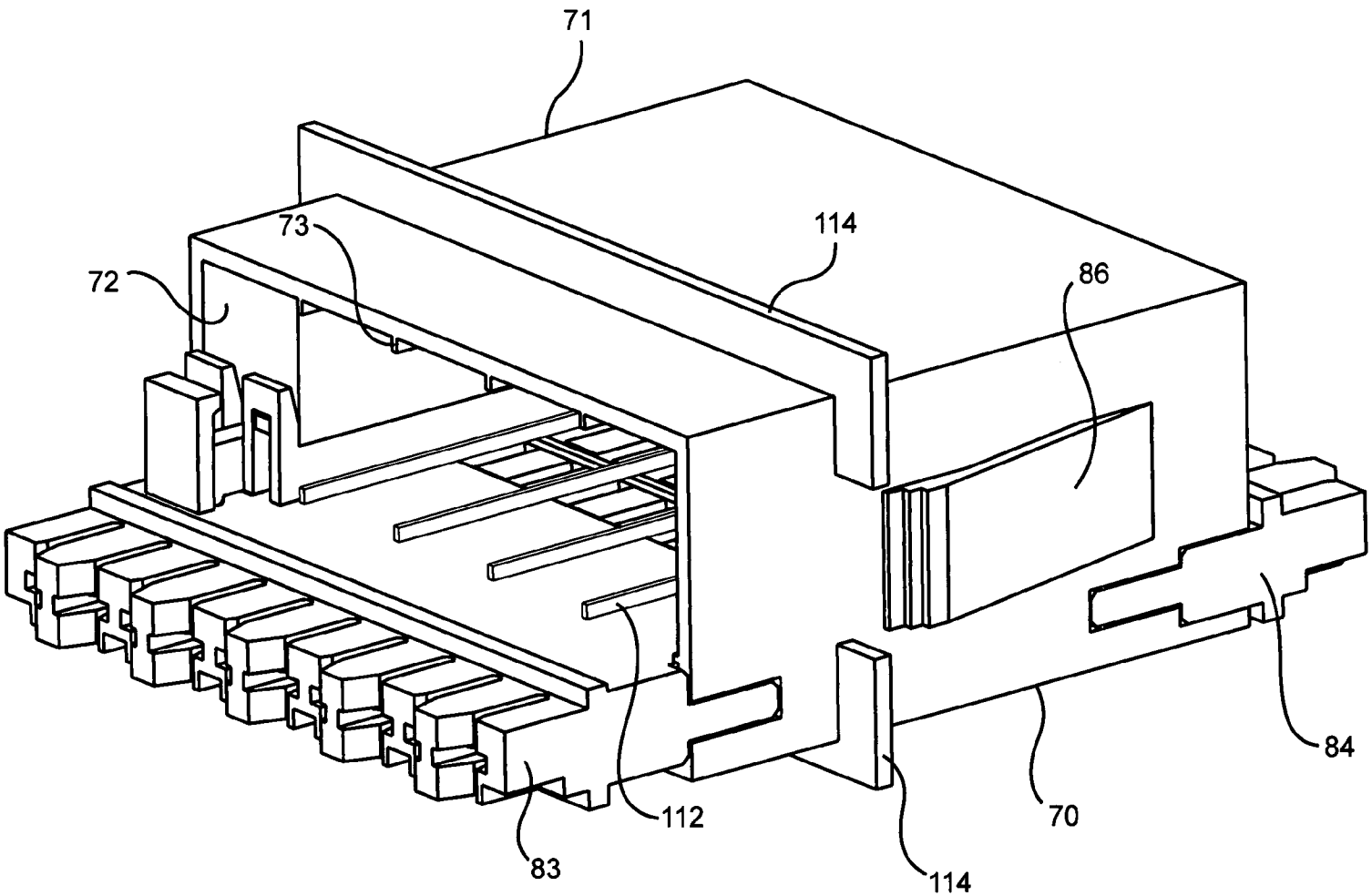
FIG. 20B is an exploded isometric view of the connector module and protection module illustrated by FIG. 18, with an alternate form of the connector module from that illustrated by FIG. 20A.

As can be seen from FIGS. 18, 20A and 20B of the drawings, a protection module 72, formed in accordance with the present invention, is preferably generally rectangular in cross-sectional shape and is received between the top wall of the outer housing 71 and the upper surface of the front contact housing 83 and/or the upper surface of the rear contact housing 84. The protection modules 72 slide in through the open front face of the connector module 70 and are held in place within the pocket or chamber thereof. The spacing between the inner surface of the top wall of the outer housing 71 and the upper surface of the front contact housing 83 and/or rear contact housing 84 is such as to allow the protection modules 72 to be received therebetween and to closely hold the protection modules in place within the interior pocket or chamber of the outer housing 71.

The inner surface of the top wall of the outer housing 71 may include a plurality of spaced apart, parallel rails or guides 73 which project inwardly of the pocket or chamber from the inner surface of the top wall of the outer housing 71. The rails or guides 73 are provided to help align each protection module 72 with the electrical contacts in the connector module 70. As shown in FIG. 20, each protection module 72 preferably includes a slot or recess 111 formed longitudinally along the length of the top wall thereof, which slot or recess receives a corresponding rail or guide 73 when the protection module 72 is mounted in the outer housing 71 atop the front contact housing 83 and/or rear contact housing 84. Alternatively, or in conjunction with the rails or guides 73 formed in the top wall of the outer housing 71, the upper surface of the front contact housing 83 and/or rear contact housing 84 may include a parallel arrangement of spaced apart rails 112 (FIG. 20B), adjacent rails partially defining slots in which respective protection modules are received and held in place. Furthermore, the rails or guides 73 formed in the top wall of the outer housing 71 may be positioned such that they are in alignment with the rails formed on the upper surface of the front contact housing 83 and/or rear contact housing 84 and define therewith a partial slot into which a corresponding protection module may be received. In such case, the slot 111 formed in the upper wall of the protection module housing may be eliminated.

The outer housing 71 of the connector module 70 may include resilient and deflectable arms 86 which extend outwardly from each lateral side wall of the outer housing 71. The arms are provided so as to resiliently snap into a panel, such as shown in FIGS. 21A–F, to allow the connector module 70 to be mounted thereto.

Figure 19:
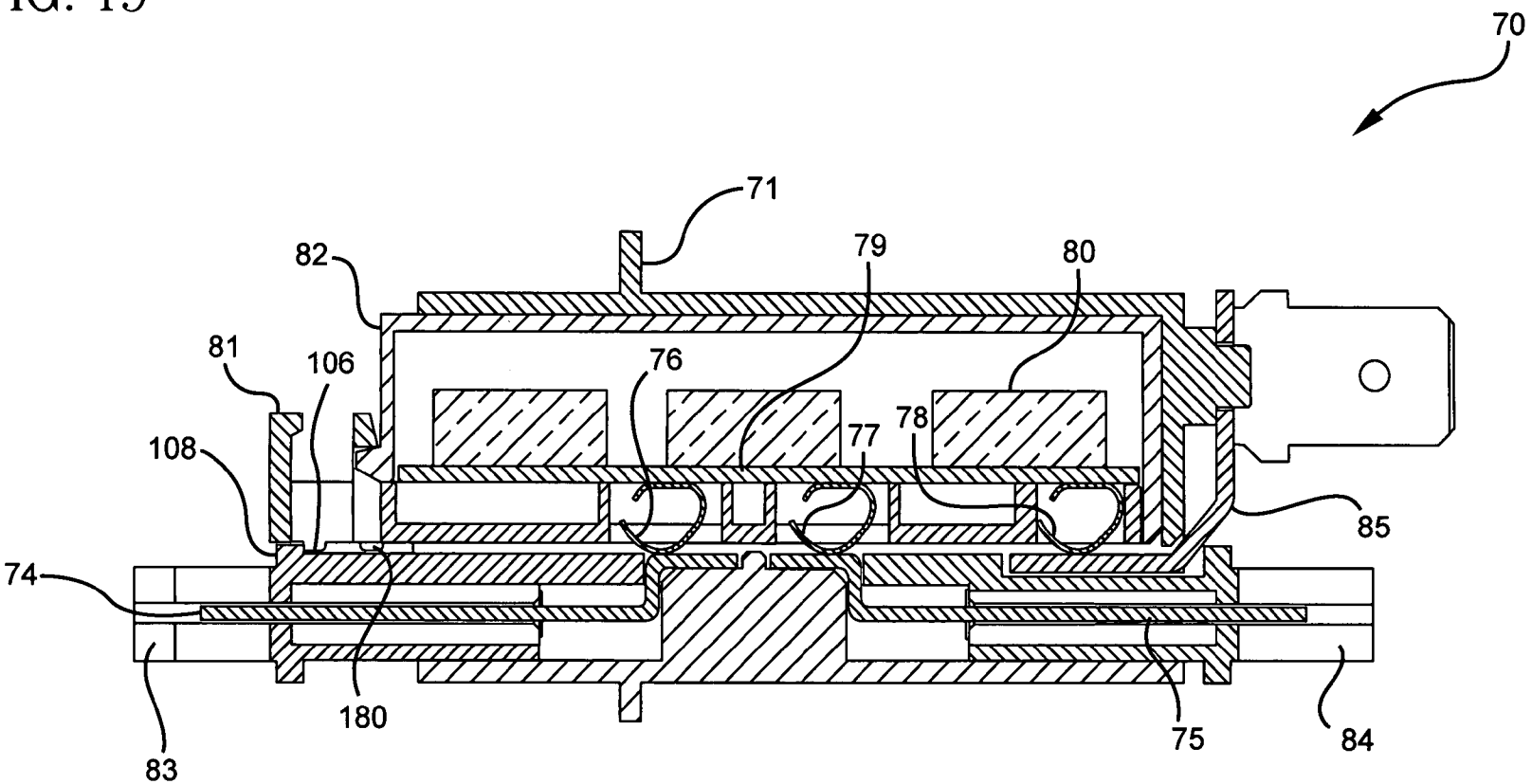
FIG. 19 is a cross-sectional view of the connector module and protection module shown in FIG. 18, taken along line 19—19 of FIG. 18.

Preferably, a plurality of pairs of front electrical contacts 74, spaced apart and in parallel with each other, and a plurality of pairs of rear electrical contacts 75, spaced apart and in parallel with each other, are mounted in the front contact housing 83 and the rear contact housing 84 respectively. Such contacts, and their arrangement with each other, are illustrated by FIG. 19 of the drawings. A pair of front electrical contacts 76 and a pair of rear electrical contacts 77, each contact of each pair being spaced apart from each other and positioned in a side-by-side relationship, project through openings formed in the lower wall of the protection module housing to resiliently engage the pairs of front and rear electrical contacts 74, 75 of the connector module 70, as clearly shown in FIG. 19. The electrical contacts 74, 75 of the connector module 70 have end portions which extend outwardly of the front contact housing 83 and rear contact housing 84, respectively, so that they are exposed and may be contacted by the electrical contacts 76, 77 of the protection module 72. Contacts 76 and 77 on the protection module are preferably resilient, curved leaf spring contacts which exert pressure on the corresponding electrical contacts 74, 75 of the connector module 70 to ensure good electrical contact therewith.

As shown in FIG. 20A, the protection module 72 includes a carrier or substrate 79 on which the electrical or mechanical protection components 80 are mounted, the protection components 80, and a housing formed of matable lower and upper housing portions 81, 82 respectively. The carrier or substrate for the protection module components may be a printed circuit board or a lead frame suitable for mounting and electrically connecting the protection components 80 to each other and to the ground 85, and to the contacts 76, 77 of the protection module 72.

The ground 85 may be an elongated member which extends across the width of the connector module 70 and which is substantially L-shaped in cross-section. It includes an outwardly extending tab which is provided for connection to a ground bus, and an inwardly bent portion which is received through an opening in the rear wall of the outer housing 71 and extends interiorly of the housing, a portion of which ground is exposed therein so that a further electrical contact 78 of the protection module 82 having a similar configuration to those of contacts 76 and 77 and at least partially protruding through the lower wall of the protection module may engage and make electrical contact with ground 85 when the protection module is mounted in the connector module 70.

The upper portion 82 of the protection module 72 housing may include one or more projections 130 which are received by slots formed in resilient arms or lugs 132 which extend upwardly from the bottom portion 81 of the housing of the protection module to hold the upper and lower portions of the protection module housing together. A further arm or lug 134 extending upwardly from the lower portion 81 of the protection module housing and spaced outwardly from the previously described arm or lug may be used for grasping using a tool or one's fingers to facilitate the insertion or removal of the protection module respectively into and out of the connector module 70.

A detent feature is provided to allow the protection module 72 to make electrical contact with a rear pair of electrical contacts 75 of the connector module 70 that is wired to the central office or the like without making electrical contact with a front pair of contacts 74 that are wired to the telecommunications equipment requiring protection. More specifically, the protection module 72 includes on the undersurface of the bottom walls thereof a pair of first and second protrusions 180, 106, which are spaced apart from each other a predetermined distance. A lip or ridge 108 running transversely across the upper surface of the front contact housing 83 projects upwardly in the direction of the downwardly extending first and second protrusions 180, 106 of the protection module. The protection module 72, when inserted into the connector module 70, has its first protrusion 180 riding up and over the ridge 108 of the connector module 70 so that the ridge 108 is in between the first and second protrusions 180, 106. The slight resistance caused by the first protrusion 180 meeting and riding up and over the ridge 108 when the protection module is partially inserted into the connector module is felt by the installer, and provides an indication that the protection module is positioned with respect to the connector module such that the rear electrical contacts 77 of the protection module are in contact and electrical communication with the corresponding rear electrical contacts 75 of the connector module and such that ground contact 78 of the protection module is in contact and electrical communication with the ground 85, without forward contacts 76 of the protection module being in electrical contact with the corresponding forward contacts 74 of the connector module 70. The installer may proceed with inserting the protection module further into the connector module whereupon the second protrusion 106 contacts and rides up over the ridge 108 on the connector module 70 so that the protection module is fully received by the connector module, and contacts 76, 77 and 78 of the protection module 72 engage and make electrical contact with contacts 74, 75 and ground 85, respectively, of the connector module 70. It is envisioned that the placement of the ridge 108 and protrusions 180, 106 may be reversed, with the ridge on each protection module and a plurality of first and second protrusions being formed on the front contact housing 83.

As with the previously described embodiments, the front contact housing 83 and/or the rear contact housing 84 of the embodiment of the connector module shown in FIGS. 18–21 may include a plurality of slits in which are exposed portions of the front contacts 74 (or rear contacts 75) so that wires may be inserted into the slits to make an electrical connection with contacts 74 (or contacts 75). The insertion or removal of wires respectively into and from the slits and corresponding connector contacts may be accomplished while the protection modules are mounted on the connector module. The upper surface of the front contact housing 83 and/or rear contact housing 84 is dimensioned in depth measured from the exposed portions of the front contacts toward the rear contact housing such that it is equal to or greater than the longitudinal length of each protection module. In this way, no portions of the protection modules overlie the slits or exposed portions of the contacts in the slits, and the front contacts may be rewired without the need to remove the protection modules from the connector module.

Figure 21B:
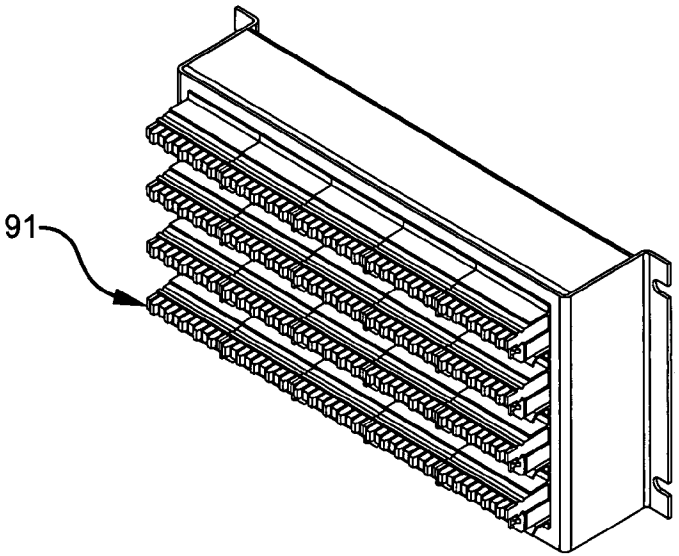
FIGS. 21A, 21B, 21C, 21D, 21E and 21F are front isometric views of several applications of the connector module formed in accordance with the present invention.
Figure 21A:
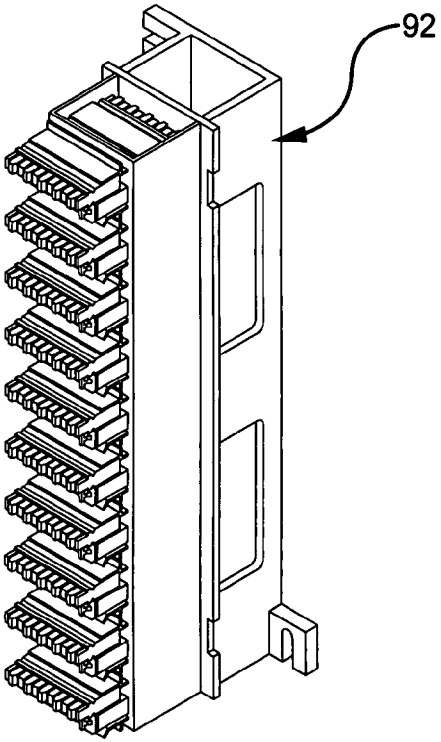
Figure 21D:
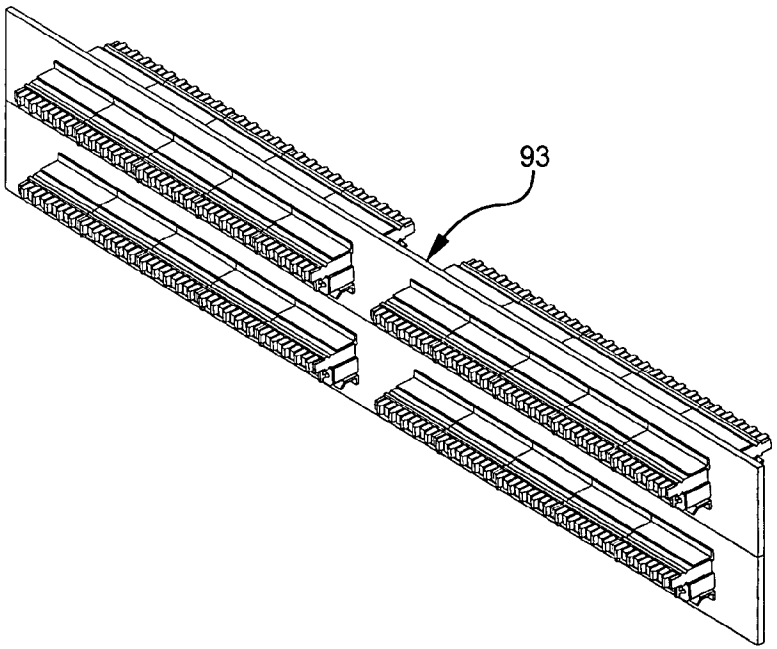
Figure 21C:
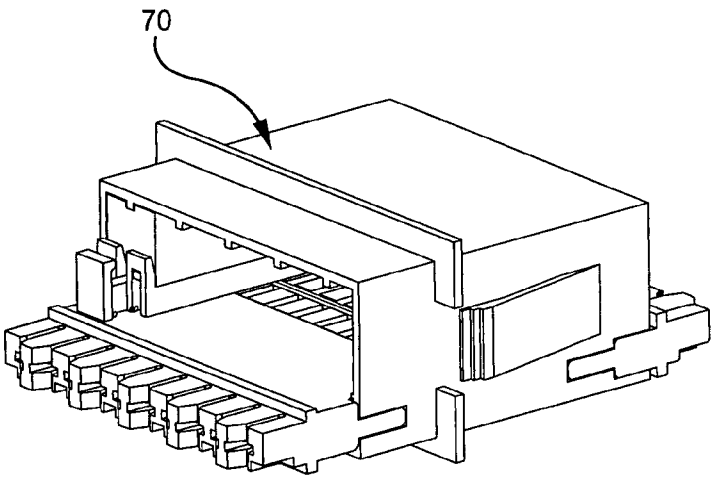
Figure 21F:
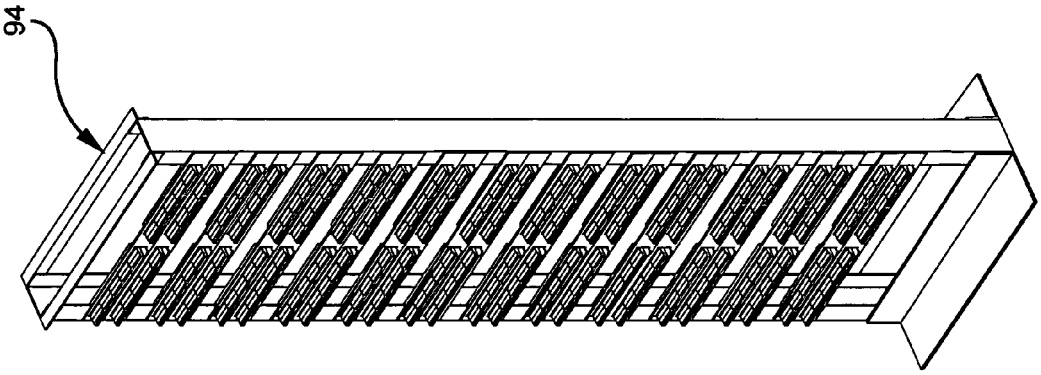
Figure 21E:
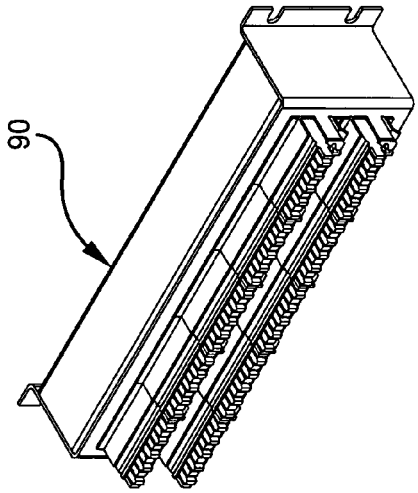

Typical applications of the connector module 70 formed in accordance with the present invention are illustrated by FIGS. 21A–F of the drawings. Such applications include a low pair count building entrance terminal (BET) 90 (FIG. 21E), a higher pair count BET 91 (FIG. 21B), a low pair count BET mounted on a No. 89D bracket 92 (FIG. 21A), a panel mount 93 (FIG. 21D) and an extra large BET rack 94 (FIG. 21F). The assembled connector module, which is the same as that shown in FIG. 18, is illustrated by FIG. 21C. Referring again to FIG. 18 of the drawings, the outer housing 71 may include a flange 114 extending partially outwardly from the top wall, bottom wall and opposite lateral side walls thereof to facilitate mounting of the connector module 70 to panels or brackets such as described previously and shown in FIGS. 21A–F.

In each of the embodiments described previously, the connector module of the present invention has its front face in which the jumper wires to telecommunications equipment are attached. The front face in each embodiment extends beyond, or more outwardly of, the axial end face of the protection modules which are mounted on the connector module. This permits the jumper wires to be removed, replaced or repositioned on the front face of the connector module without the need to remove the protection modules therefrom in order to gain access to the jumper wires. Furthermore, the protection modules are positioned to be installed on the same side of the connector module as the jumper wires, so that there is no need to gain access to the rear of the connector module, or connector blocks or the like formed from a plurality of connector modules, by the installer or technician when he is rewiring the jumper wires on the connector module. Having the axial end face of the protection module recessed with respect to the jumper wire receiving slits on the connector module greatly facilitates the installer's ability to make changes to the equipment wiring on the connector module and allows for an efficient and cost effective procedure for accomplishing such rewiring.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A connector module for a telecommunications system, which comprises:

a main body portion, the main body portion having a front cap and a rear cap opposite the front cap, the front cap and the rear cap residing in different planes and being elevationally offset from each other to define a middle portion, the middle portion having a front facing surface recessed from the front cap, the front cap defining the front of the connector module, and the rear cap defining the opposite rear of the connector module, at least the front cap having a plurality of slits formed therein, each slit of the plurality of slits being provided to permit insertion of a wire therein; and a plurality of first electrical contacts at least partially disposed within the front cap of the main body portion, each first electrical contact of the plurality of first electrical contacts being aligned with a respective one of the plurality of slits and having a portion thereof being exposed through the respective one of the plurality of slits to be electrically contactable with a wire received by the respective one of the plurality of slits;

wherein the main body portion has an upper surface for supporting a plurality of protection modules thereon between the front cap and the front facing surface of the middle portion, the depth of the upper surface between the front cap and the front facing surface of the middle portion being dimensioned to be equal to or greater than the longitudinal length of the protection modules so that the protection modules, when supported on the upper surface of the main body portion, have no portion thereof overlying the plurality of slits formed in the front cap and so as not to interfere with the placement and removal of wires respectively into and from the plurality of slits and the selective electrical connection with the plurality of first electrical contacts while the protection modules are supported on the main body portion of the connector module.

2. A connector module for a telecommunications system as defined by claim 1, wherein the front facing surface of the middle portion has a plurality of openings formed therein for receiving outwardly extending portions of the protection modules.

3. A connector module for a telecommunications system as defined by claim 1, wherein the front facing surface of the middle portion includes ground contacts extending outwardly therefrom for being received by corresponding openings formed in the protection modules.

4. A connector module for a telecommunications system as defined by claim 1, wherein the protection module supporting surface includes means for retaining the protection modules in place on the supporting surface.

5. A connector block having a plurality of connector modules as defined by claim 1.

6. A connector module for a telecommunications system as defined by claim 1, wherein the main body portion has a plurality of guide channels formed therein for receiving respective wires for connection to the plurality of first electrical contacts.

7. A connector module for a telecommunications system as defined by claim 6, wherein the main body portion further includes opposite lateral side walls; wherein at least one of the opposite lateral side walls has formed therein a plurality of side openings; wherein a plurality of front openings are formed in the front cap of the main body portion, each front opening of the plurality of front openings being situated in close proximity to the exposed portion of a respective first electrical contact of the plurality of first electrical contacts and to a respective slit of the plurality of slits; and wherein the side openings and front openings communicate with respective guide channels to allow electrical wires to be received by the side openings, guide channels and front openings for routing of the wires to the first electrical contacts at the plurality of slits formed in the front cap.

8. A connector module for a telecommunications system as defined by claim 1, wherein the protection module supporting surface includes a plurality of projections extending outwardly therefrom, the projections selectively lockingly engaging the protection modules positioned on the supporting surface to selectively secure the protection modules thereto.

9. A connector module for a telecommunications system as defined by claim 8, wherein the projections have a dovetail configuration in transverse cross-section.

10. In combination:

a connector module for a telecommunications system having a main body portion and a plurality of first electrical contacts, the main body portion having a front cap and a rear cap opposite the front cap, the front cap and the rear cap residing in different planes and being elevationally offset from each other to define a middle portion, the middle portion having a front facing surface recessed from the front cap, the front cap defining the front of the connector module, and the rear cap defining the opposite rear of the connector module, at least the front cap having a plurality of slits formed therein, each slit of the plurality of slits being provided to permit insertion of a wire therein, the plurality of first electrical contacts being at least partially disposed within the front cap of the main body portion, each first electrical contact of the plurality of first electrical contacts being aligned with a respective one of the plurality of slits and having a portion thereof being exposed through the respective one of the plurality of slits to be electrically contactable with a wire received by the respective one of the plurality of slits, the main body portion having and upper surface for supporting a plurality of protection modules thereon between the front cap and the front facing surface of the middle portion, the depth of the upper surface between the front cap and the front facing surface of the middle portion being dimensioned to be at least equal to the longitudinal length of the protection modules so that the protection modules, when supported on the upper surface of the main body portion, have no portion thereof overlying the plurality of slits formed in the front cap and so as not to interfere with the placement and removal of wires respectively into and from the plurality of slits and the selective electrical connection with the plurality of first electrical contacts while the protection modules are supported on the main body portion of the connector module; and a plurality of protection modules, each protection module of the plurality of protection modules being selectively in electrical communication with at least one first electrical contact of the plurality of first electrical contacts when the protection module is supported on the main body portion of the connector module, each protection module of the plurality of protection modules having a longitudinal length which is equal to or less than the distance between the front facing surface of the middle portion of the connector module and the front cap of the connector module so as not to overlie a corresponding slit of the plurality of slits and so as not to interfere with the placement and removal of wires respectively into and from the plurality of slits and the selective electrical connection with the plurality of first electrical contacts while the protection modules are supported on the main body portion of the connector module.

11. In combination:

a connector module for a telecommunications system and a plurality of protection modules electrically connectable thereto, each protection module having a housing defining a cavity therein, a carrier at least partially residing in the housing, and protection components mounted on the carrier, the housing having a lower wall through which an extended portion of the carrier protrudes, the extended portion of the carrier having exposed electrical contacts situated thereon, the connector module including an insulating housing having a rear contact holder portion and a front contact housing joined to the rear contact holder portion, a plurality of rear electrical contacts at least partially housed by the rear contact holder portion, a plurality of front electrical contacts at least partially housed by the front contact housing, at least one of the front contact housing and the rear contact holder portion having an upper surface and a plurality of grooves formed in the upper surface thereof, each groove being positioned in proximity to a respective front electrical contact and a respective rear electrical contact such that portions of the respective front electrical contact and rear electrical contact are exposed and extend partially into the respective groove, a respective protection module of the plurality of protection modules being selectively mountable on the upper surface of the at least one of the front contact housing and the rear contact holder portion such that the extended portion of the carrier thereof is slidably receivable in a respective groove formed in the upper surface with the contacts on the extended portion being positionable in electrical contact with at least one of the front electrical contacts and with at least one of the rear electrical contacts of the connector module, at least the front contact housing having a plurality of slits formed therein, at least one of the front electrical contacts of the plurality of front electrical contacts being aligned with a respective one of the plurality of slits and having a portion thereof being exposed through the respective one of the plurality of slits to be electrically contactable with a wire received by the respective one of the plurality of slits, the upper surface on which the protection modules are mountable having a depth measured from the exposed portions of the front electrical contacts backward in the direction of the rear contact holder portion which is particularly dimensioned to be equal to or greater than the longitudinal length of each protection module of the plurality of protection modules such that, when the protection modules are mounted on the upper surface, the protection modules have no portion thereof overlying the plurality of slits and the front electrical contact portions exposed within the slits and so as not to interfere with the placement and removal of wires respectively into and from the plurality of slits and the selective electrical connection with the plurality of front electrical contacts while the protection modules are mounted on the upper surface of the at least one of the front contact housing and the rear contact holder portion of the connector module.

12. A combination as defined by claim 11, wherein the front electrical contacts are arranged side-by-side to define adjacent front electrical contacts; wherein the rear electrical contacts are arranged side-by-side to define adjacent rear electrical contacts; wherein each groove of the plurality of grooves formed in the upper surface of the at least one of the front contact housing and the rear contact holder portion is positioned between respective adjacent front electrical contacts and between respective adjacent rear electrical contacts such that portions of the respective adjacent front electrical contacts and portions of the respective adjacent rear electrical contacts are exposed and extend partially into the respective groove therebetween; and wherein the carrier of the protection module includes opposite sides on which the exposed electrical contacts are situated for electrically contacting the exposed portions of the respective adjacent front electrical contacts and the exposed portions of the respective adjacent rear electrical contacts.

13. A combination as defined by claim 11, wherein the connector module further includes an outer housing joined to at least one of the front contact housing and the rear contact holder portion and situated to at least partially overlie the upper surface of the at least one of the front contact housing and the rear contact holder portion, the outer housing having a top wall which is spaced apart from the upper surface a distance such that the plurality of protection modules is closely received between the top wall of the outer housing and the upper surface.

14. A connector block having a plurality of connector modules as defined by claim 11.

15. In combination:

a connector module for a telecommunications system and a plurality of protection modules electrically connectable thereto, each protection module having a housing defining a cavity therein, a carrier residing in the housing, protection components mounted on the carrier, and electrical contacts electrically connected to the carrier, the housing including a wall having openings formed through the thickness thereof, the electrical contacts being in electrical communication with the carrier and protection components mounted thereon and being situated to at least partially extend through the openings formed in the wall to define exposed portions of the electrical contacts, the connector module including an insulated housing having an outer housing, a front contact housing and a rear contact housing, the outer housing defining an interior chamber in which is at least partially received the front contact housing and the rear contact housing, the outer housing having a top wall, and at least one of the front contact housing and the rear contact housing having an upper surface on which is mountable the plurality of protection modules, the top wall of the housing and the upper surface of the at least one of the front contact housing and the rear contact housing defining a space therebetween which is dimensioned to receive therein the plurality of protection modules, the connector module having a plurality of front electrical contacts and a plurality of rear electrical contacts, the front contact housing at least partially housing the plurality of front electrical contacts, the rear contact housing at least partially housing the plurality of rear electrical contacts, portions of the front electrical contacts and the rear electrical contacts respectively extending from the front contact housing and the rear contact housing and being exposed within the interior chamber of the outer housing to define exposed contact portions, the exposed contact portions of a respective protection module electrical contact being contactable with the exposed contact portions of respective front and rear electrical contacts of the connector module when the respective protection module is received by the interior chamber of the outer housing, at least the front contact housing having a plurality of slits formed therein, at least one of the front electrical contacts of the plurality of front electrical contacts being aligned with a respective one of the plurality of slits and having a portion thereof being exposed through the respective one of the plurality of slits to be electrically contactable with a wire received by the respective one of the plurality of slits, the upper surface on which the protection modules are mountable having a depth measured from the exposed portions of the front electrical contacts backward in the direction of the rear contact housing which is particularly dimensioned to be equal to or greater than the longitudinal length of each protection module of the plurality of protection modules such that, when the protection modules are mounted on the upper surface, the protection modules have no portion thereof overlying the plurality of slits and the front electrical contact portions exposed within the slits and so as riot to interfere with the placement and removal of wires respectively into and from the plurality of slits and the selective electrical connection with the plurality of front electrical contacts while the protection modules are mounted on the upper surface of the at least one of the front contact housing and the rear contact housing of the connector module.

16. A combination as defined by claim 15, wherein the top wall of the outside housing includes a plurality of rails partially extending into the interior chamber defined by the outer housing; and wherein each protection module of the plurality of protection modules includes a top wall having a recess formed longitudinally therein, a respective rail of the plurality of rails being receivable by the recess of a respective protection module of the plurality of protection modules when the respective protection module is slidably received in the interior chamber of the outer housing between the top wall thereof and at least the upper surface of the at least one of the front contact housing and the rear contact housing.

17. A combination as defined by claim 15, wherein the top wall of the outer housing has a plurality of first rails extending downwardly therefrom and at least partially into the interior chamber of the outer housing; and wherein the upper surface of the at least one of the front contact housing and the rear contact housing includes a plurality of second rails formed thereon and extending upwardly therefrom and at least partially into the interior chamber of the outer housing, respective first rails of the plurality of first rails and respective second rails of the plurality of second rails being aligned with each other to at least partially define slots between adjacent first and second rails, respective protection modules being receivable within corresponding slots defined by adjacent first and second rails within the interior chamber of the outer housing.

18. A combination as defined by claim 15, wherein each protection module of the plurality of protection modules includes a first protrusion and a second protrusion, the first and second protrusions being spaced apart a predetermined distance from each other in a direction along the longitudinal axis of the protection module; and wherein the front contact housing includes at least one ridge extending outwardly from a surface thereof and at least partially transversely across the width of the front contact housing, the first and second protrusions of the protection modules engaging the at least one ridge of the front contact housing when the protection modules are inserted into the interior chamber of the outer housing, the first and second protrusions and the at least one ridge together providing an indication of the position of the protection modules with respect to at least the front contact housing and the state of electrical communication between the electrical contacts of the protection modules and the front electrical contacts and rear electrical contacts of the connector module.

19. A connector block having a plurality of connector modules as defined by claim 15.

* * * * *